US006216508B1

(12) United States Patent
Matsubara et al.

(10) Patent No.: US 6,216,508 B1
(45) Date of Patent: Apr. 17, 2001

(54) APPARATUS FOR DIELESS FORMING PLATE MATERIALS

(75) Inventors: Shigeo Matsubara, Machida; Hiroyuki Amino, Fujinomiya; Susumu Aoyama, Misato; Yan Lu, Fujinomiya, all of (JP)

(73) Assignees: Amino Corporation, Shizuoka-Ken; Shigeo Matsubara, Tokyo, both of (JP)

( * ) Notice: Subject to any disclaimer, the term of this patent is extended or adjusted under 35 U.S.C. 154(b) by 0 days.

(21) Appl. No.: 09/341,596

(22) PCT Filed: Jan. 29, 1999

(86) PCT No.: PCT/JP99/00407

§ 371 Date: Jul. 12, 1999

§ 102(e) Date: Jul. 12, 1999

(87) PCT Pub. No.: WO99/38627

PCT Pub. Date: Aug. 5, 1999

(30) Foreign Application Priority Data

Jan. 29, 1998 (JP) ..... 10-031981

(51) Int. Cl.[7] ..... B21D 5/06

(52) U.S. Cl. ..... 72/43; 72/75; 72/125; 72/297; 72/306; 72/379.2

(58) Field of Search ..... 72/297, 301, 306, 72/311, 379.2, 302, 43, 75, 125, 126

(56) References Cited

U.S. PATENT DOCUMENTS 2,762,417 * 9/1956 Oeckl ..... 72/297
2,945,528 * 7/1960 Roux ..... 72/297

FOREIGN PATENT DOCUMENTS 5-31537 * 2/1981 (JP) .
56-14031 * 2/1981 (JP) ..... 72/297
7-132329 5/1995 (JP) .
9-10855 * 1/1997 (JP) .
9-85355 * 3/1997 (JP) .
WO 89/01370 * 2/1989 (WO) ..... 72/297

* cited by examiner

*Primary Examiner*—Daniel C. Crane
(74) *Attorney, Agent, or Firm*—Michael J. Striker

(57) ABSTRACT

The invention relates to an apparatus for the dieless forming of a sheet. The apparatus comprises a pressing mechanism and a sheet holding mechanism which are moved with respect to each other in X, Y and Z-axis directions and has a fixed ceiling plate form having a plane shape matching the bottom profile of a product to be formed; a framelike support plate surrounding the ceiling plate form is raised and lowered by at least one pair of raising/lowering actuators, and restraining actuators apply a controllable restraining force to the sheet byway of a framelike restraining plate clamping the periphery of the sheet in the sheet thickness direction between itself and the support plate. A mechanism for causing the support plate to undergo balanced movement and a material flow control mechanism may be preferably further provided.

25 Claims, 26 Drawing Sheets

FIG.17-A
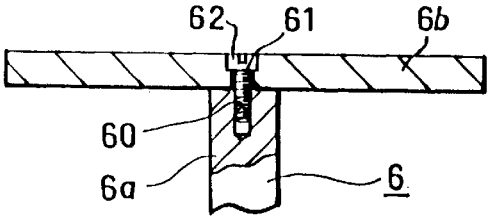
FIG.17-B
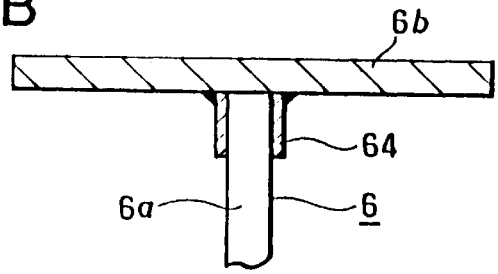
FIG.19
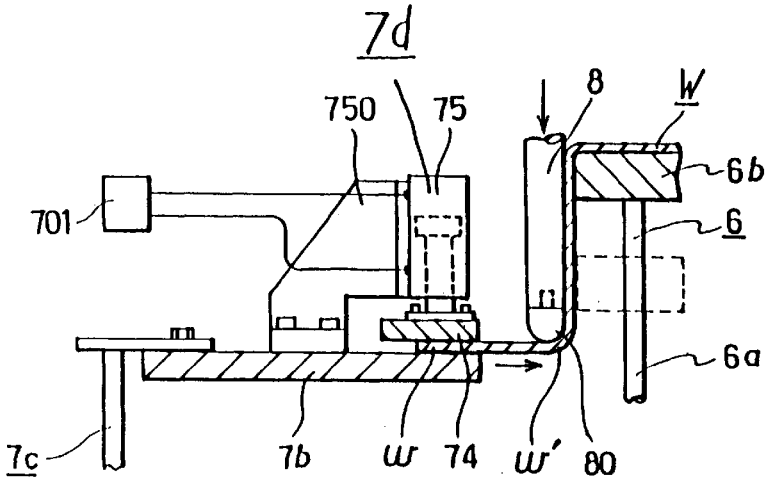

FIG.38-A
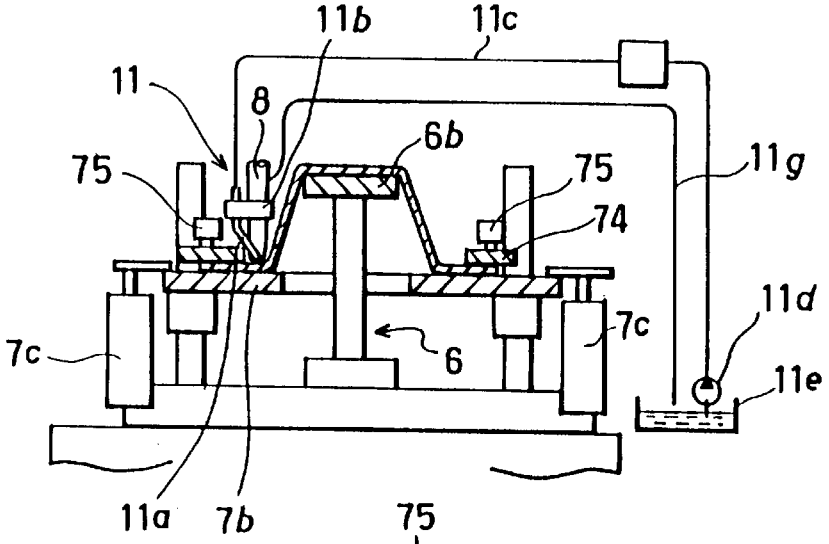
FIG.38-B
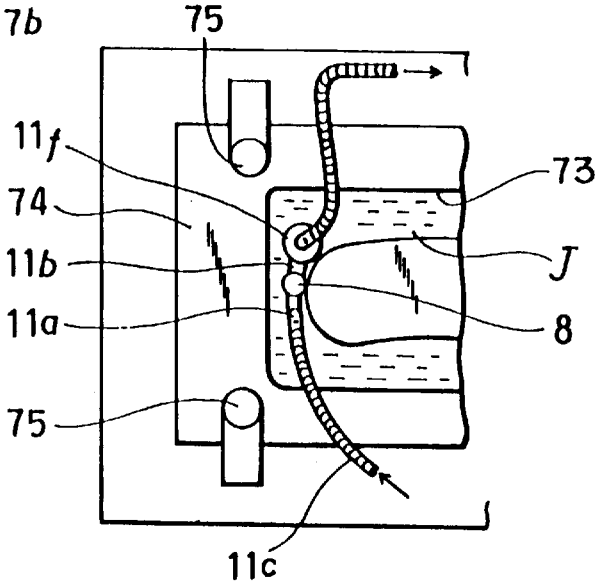
FIG.18-A
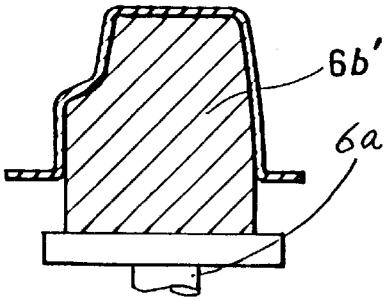
FIG.18-B
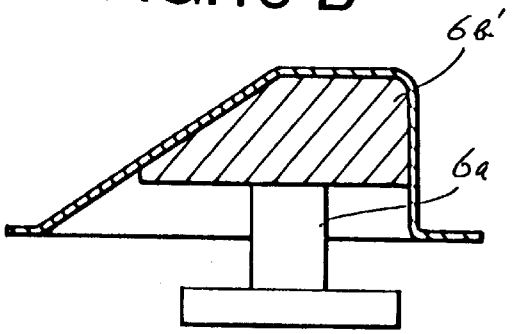

FIG.22-A
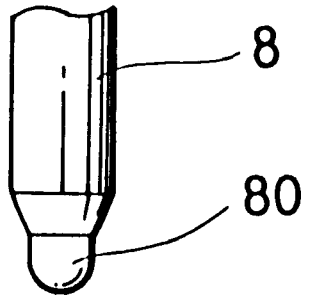
FIG.22-B
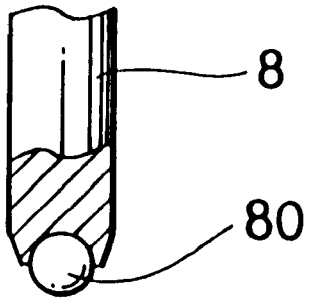
FIG.22-C
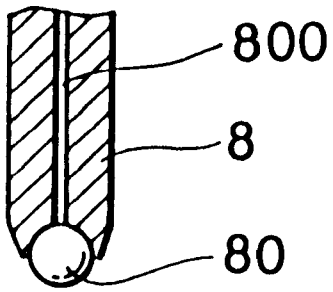

FIG.23-A
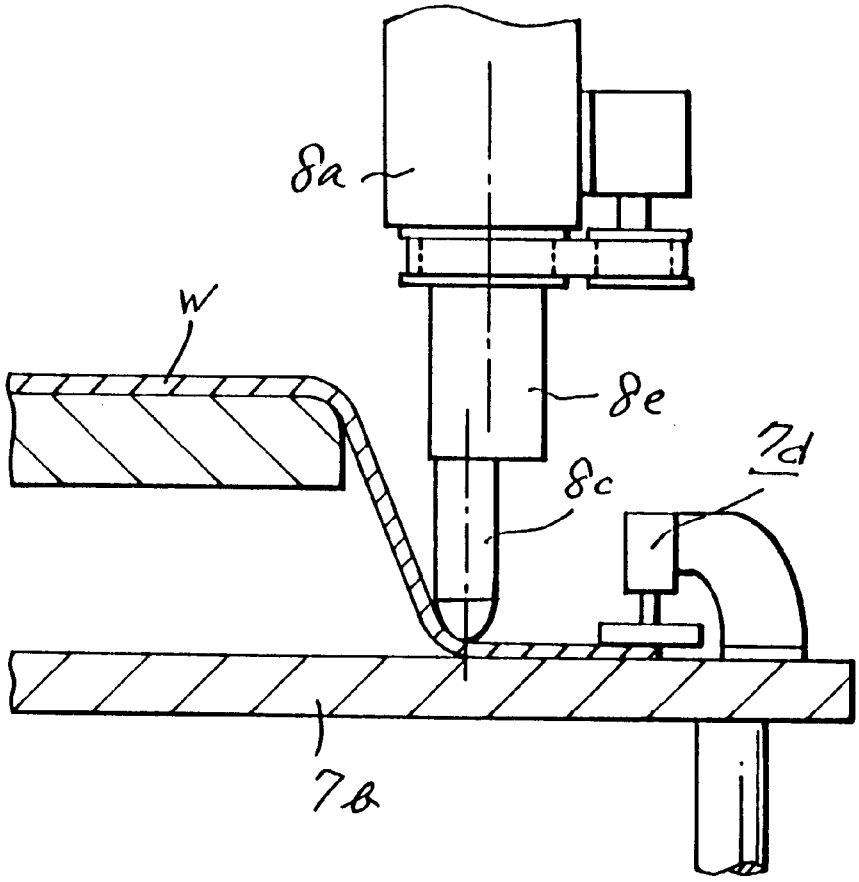
FIG.23-B
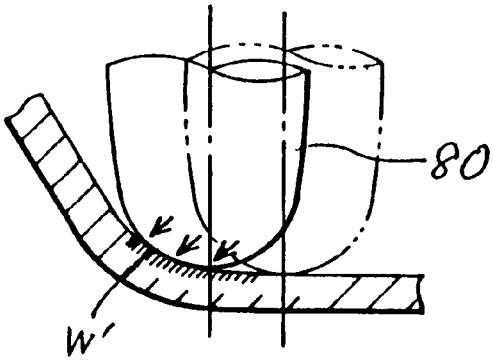

FIG.25-A
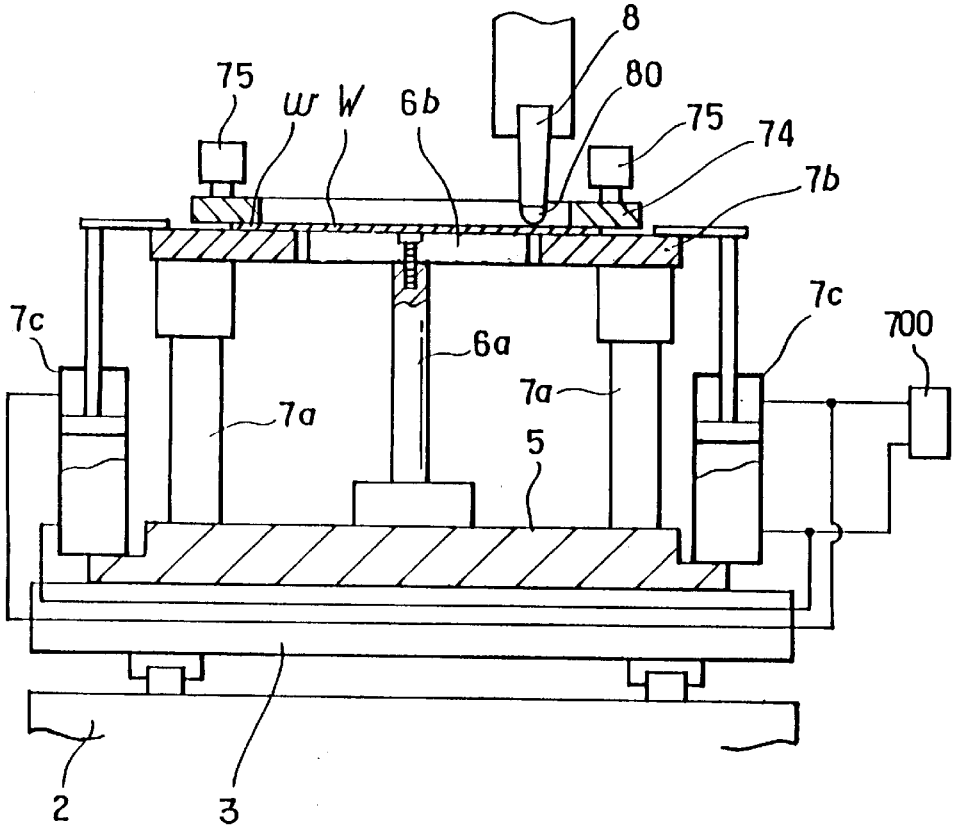
FIG.25-B
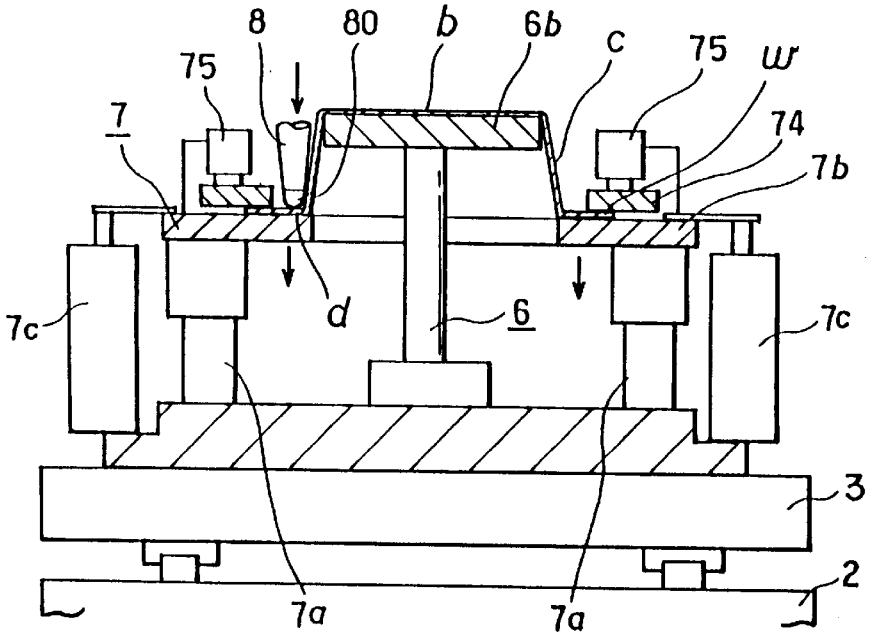

FIG.26
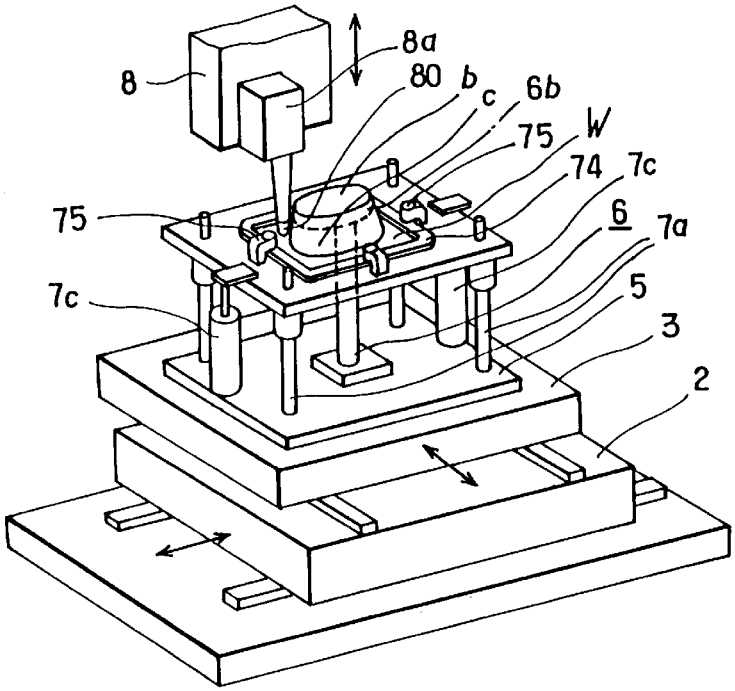
FIG.27-A
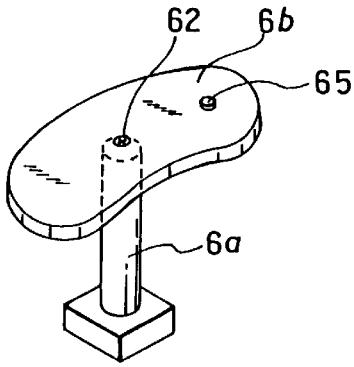
FIG.27-B
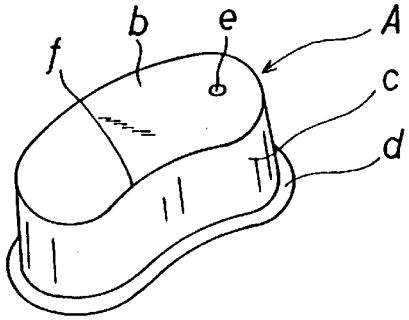

FIG.28-A
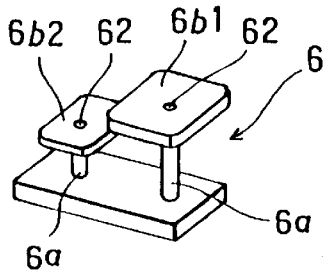
FIG.28-B
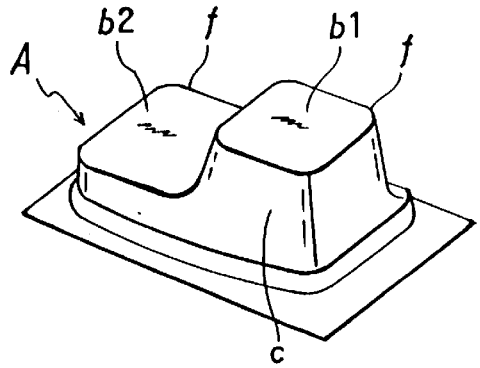
FIG.29-A
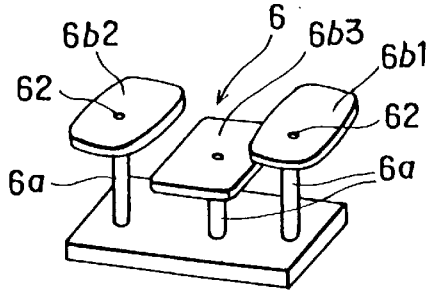
FIG.29-B
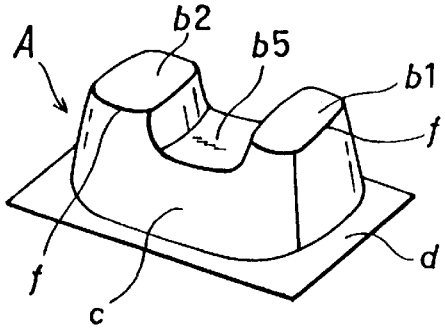
FIG.30-A
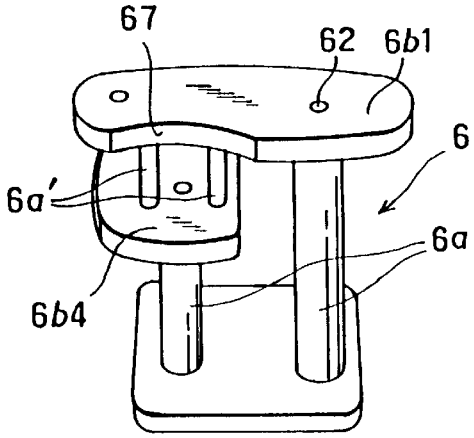
FIG.30-B
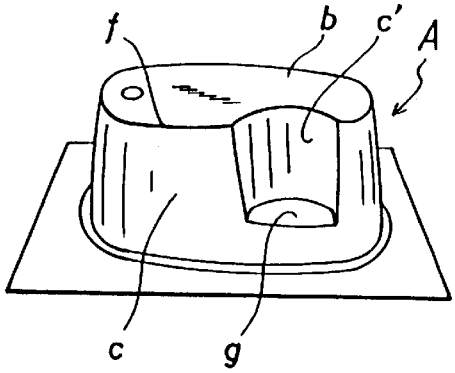

FIG.31-A
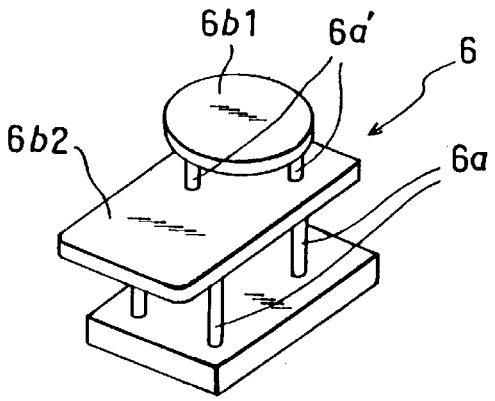
FIG.31-B
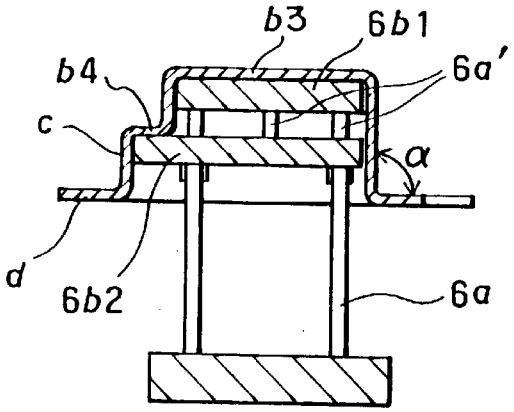
FIG.31-C
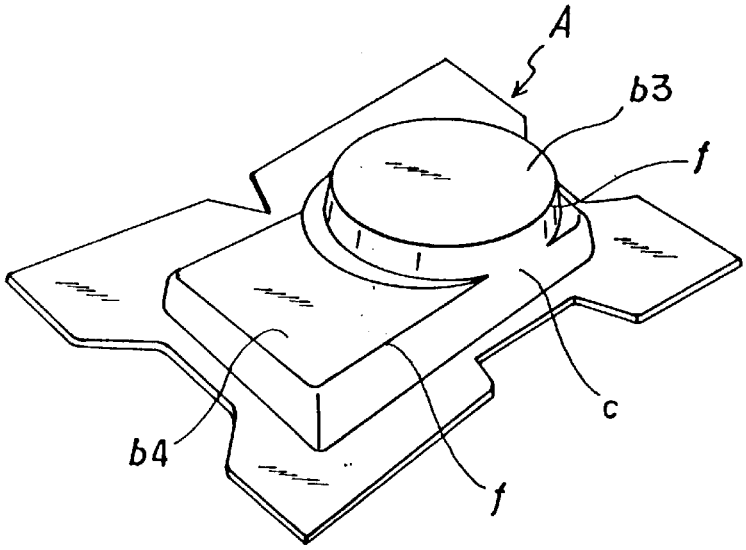

FIG.32-A
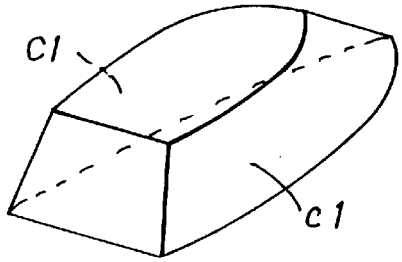
FIG.32-B
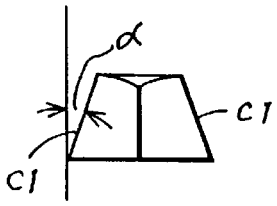
FIG.32-C
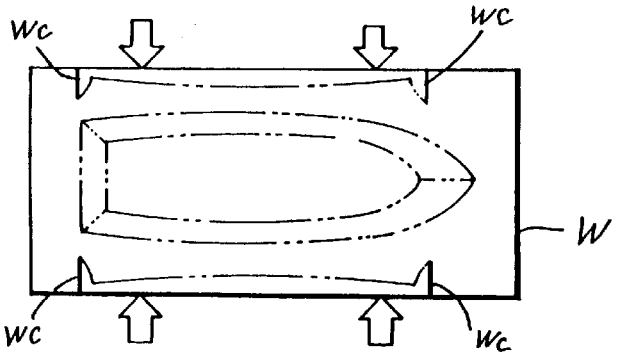
FIG.32-D
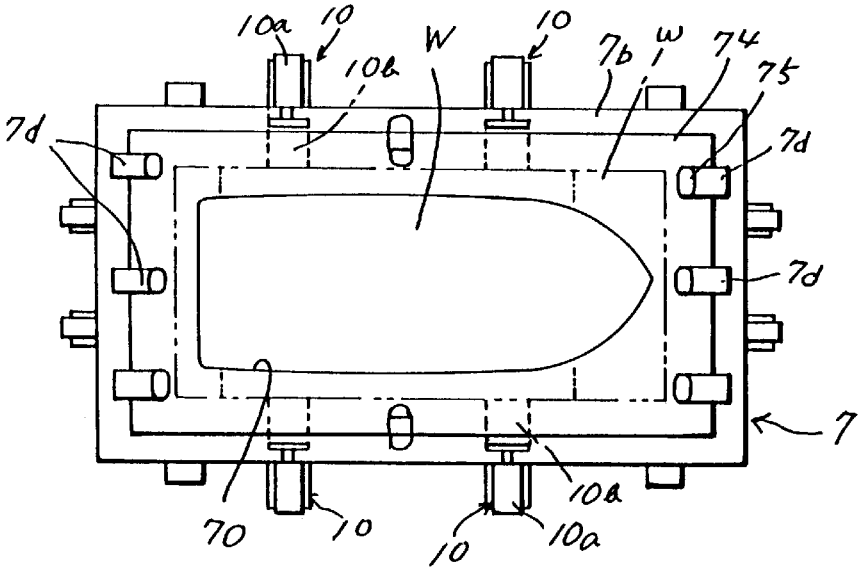

FIG.33-A
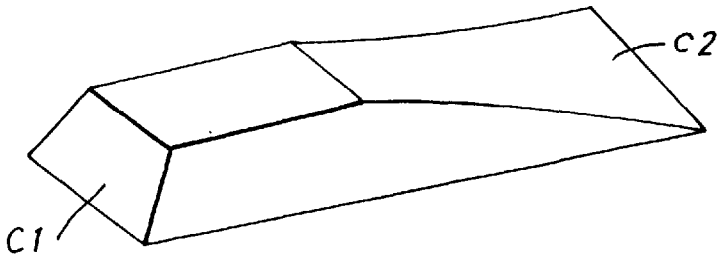
FIG.33-B
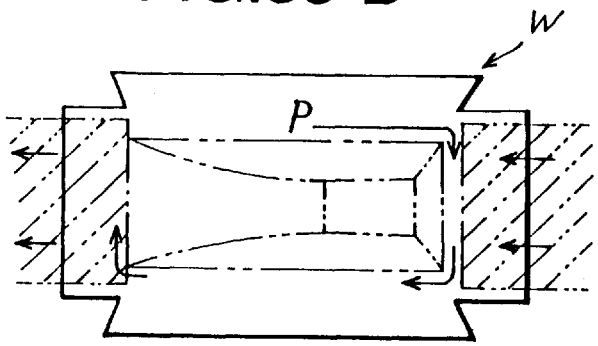
FIG.33-C
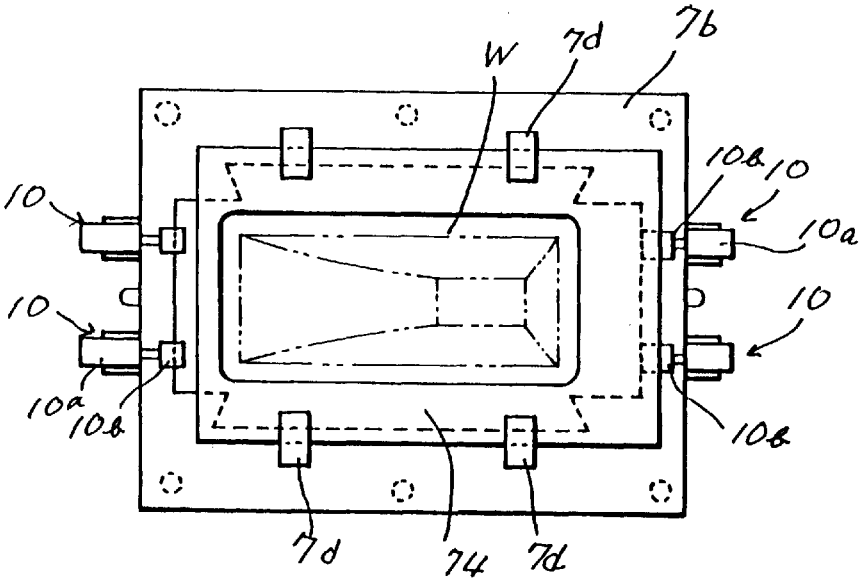

FIG.34-A
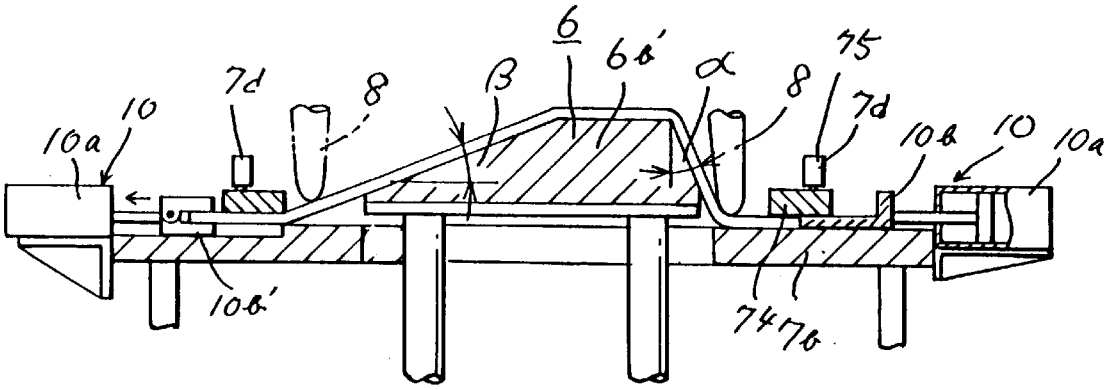
FIG.34-B
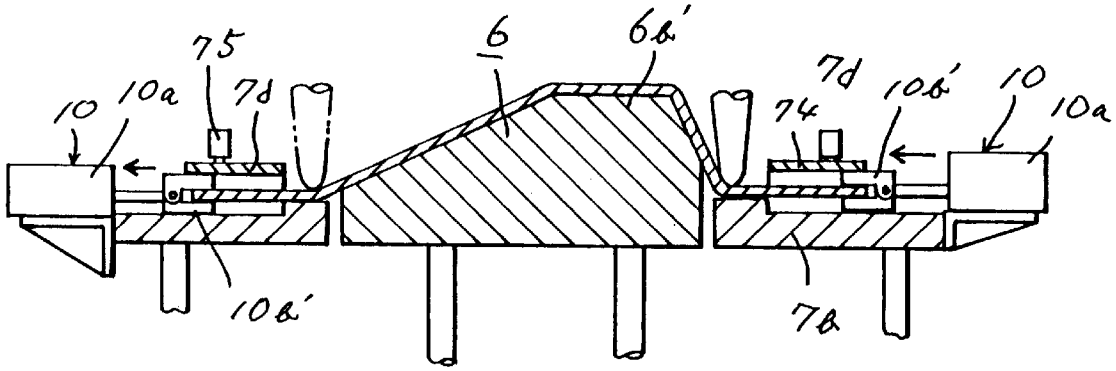

FIG.35-A
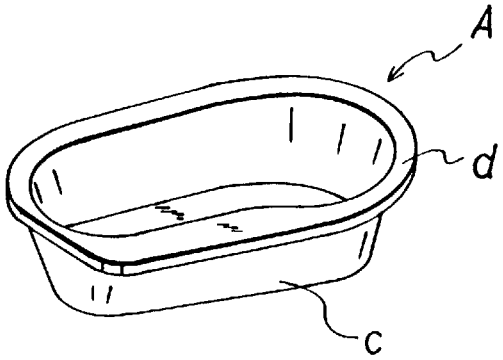
FIG.35-B
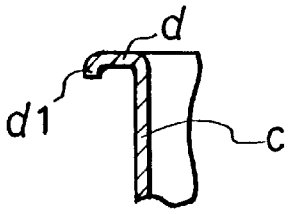
FIG.35-C
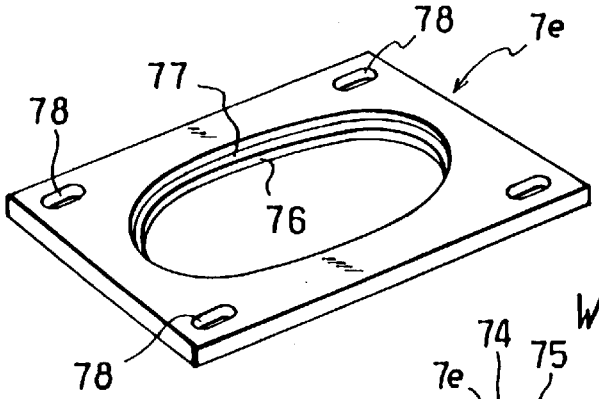
FIG.35-D
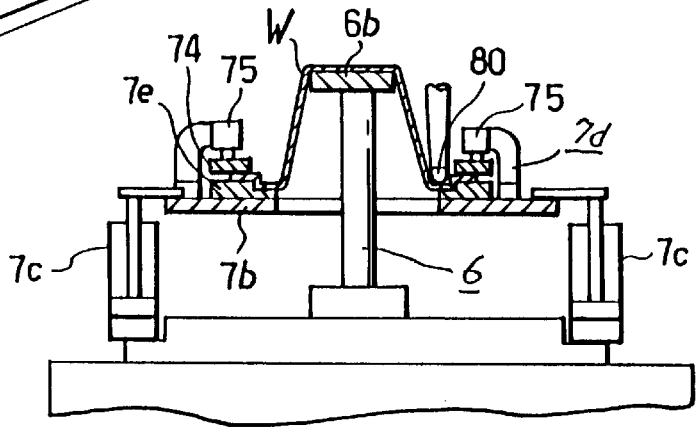
FIG.35-E
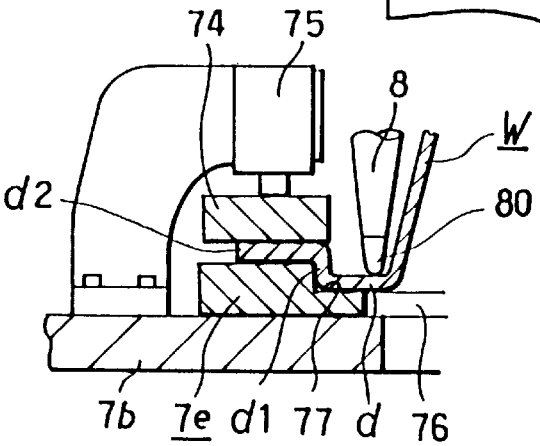

FIG.36-A
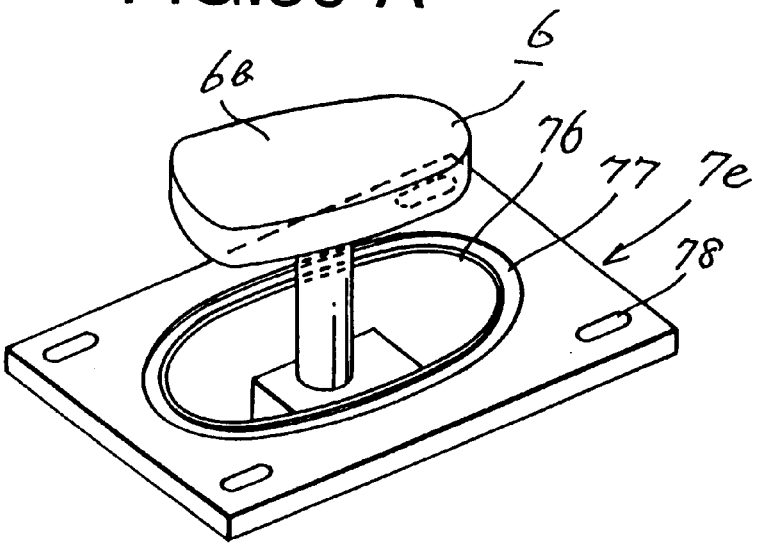
FIG.36-B
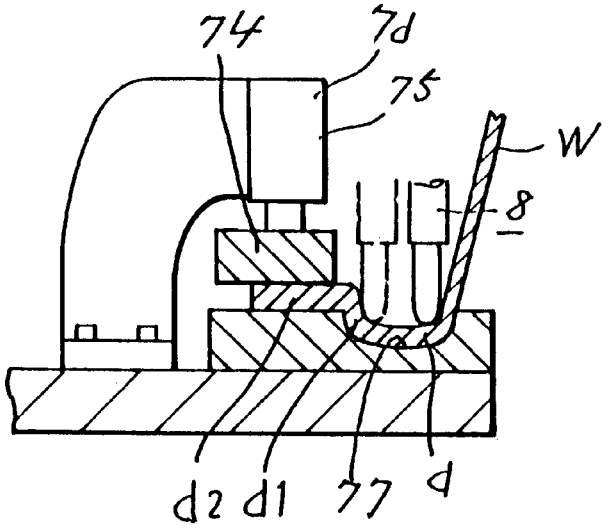

FIG.37-A
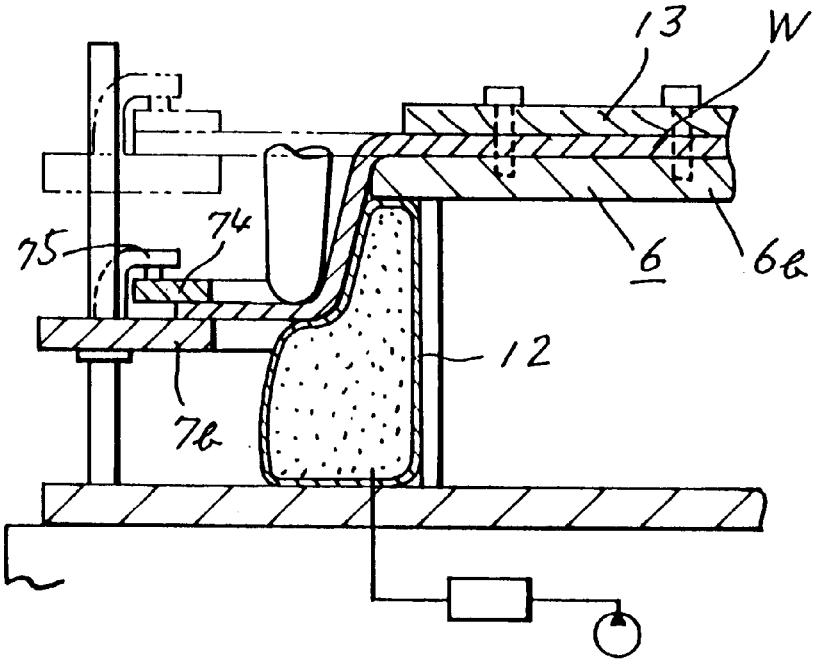
FIG.37-B
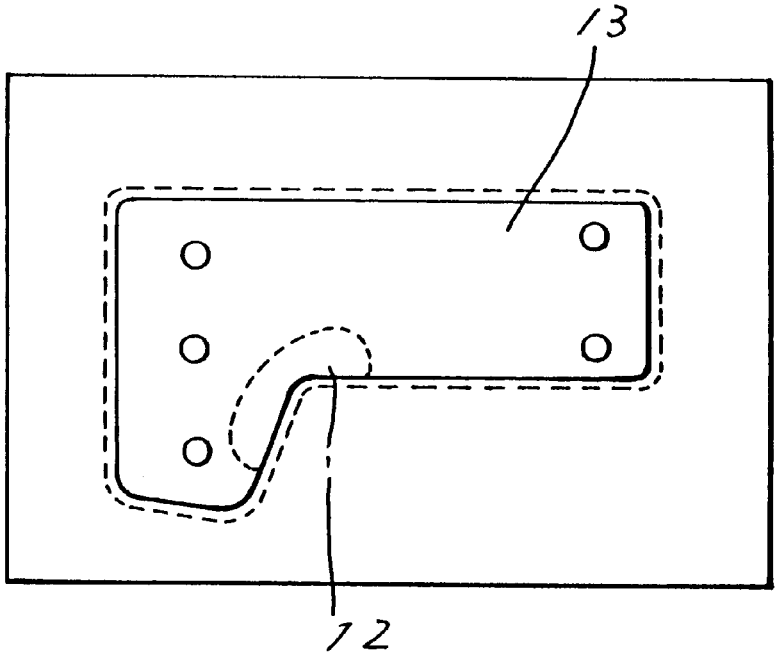

APPARATUS FOR DIELESS FORMING PLATE MATERIALS

TECHNICAL FIELD

This invention relates to an improvement to an apparatus for progressively forming a sheet into any three-dimensional shape having a relatively large bottom area.

BACKGROUND OF THE INVENTION

For the plastic working of airplane and automobile parts, marine products such as boats, building materials, kitchen fitments, and bathroom fitments such as bath tubs, press-working using metal dies has been generally used. However, with methods using metal dies and presses, the plant is large and a large installation space is required, and plant costs and die-making costs are extremely high. Also, the forming of complex shapes is difficult and requires high-level process technology and finishing skill. Furthermore, because press operation produces noise and vibration it has an adverse affect on the environment, and safety measures have also been problematic.

One known alternative is the spinning method, but because this method involves molding a sheet by pressing it onto a rotating mold it has had the fatal shortcoming that it is only possible to form moldings whose cross-section is a circular cylindrical or conical shape.

In this connection, in Japanese Unexamined Patent Publication No. 7-132329, one of the present inventors has proposed a progressive sheet-forming method and apparatus. In this prior art, a barlike pressing member having a spherical end part is brought into contact with the underside of a sheet; a moving pressing member having a spherical pressing part is brought into contact with the other side (the upper side) of the sheet; and, with the periphery of the sheet held with a fixed holding force by a screw-type holding tool, the moving pressing member is moved around the barlike pressing member in correspondence with the cross-sectional shape of a product to be formed while the holding tool is moved in the thickness direction of the sheet by a spring-type cushion.

However, with this prior art, although the forming of simple diverging shapes such as conical shapes and pyramid shapes is possible, the forming of shapes wherein a bottom and a side wall part (trunk part) join at a sharp corner is not possible, and in particular, when the dimensions of a product are large, because the framelike holding tool supporting the sheet tends to incline and drop, there have been problems of forming becoming impossible or the accuracy of the formed shape deteriorating. Consequently the forming of products, typified by bath tubs and sinks, which have a large bottom area, of which furthermore the bottom profile shape may be irregular, and which have a high side wall part continuing from a bottom part, or which have a step at an intermediate level in a side wall, has been impossible.

Also, because this prior art is simple stretch-forming, carried out with the periphery of the sheet clamped, when the forming of a side wall which is vertical or at a near-vertical angle $\alpha$ is carried out, a blank of a length $l_0$ in the horizontal state extends to a length $l_1$, and along with this the sheet thickness decreases from $t_0$ to $t_1$ ($t_1=t_0 \sin\alpha$), so that for example a sheet thickness of 2 mm decreases to 0.17 mm, and thus the percentage sheet thickness decrease is high. Consequently there has been the problem that, depending on the material of the sheet and the sheet thickness, cracks may form in the side wall and local deformation may occur so that forming is almost impossible, and even if forming is possible there is a marked fall in strength.

There has also been the problem that when a hard sheet such as a stainless steel sheet is formed by this prior art method it is difficult to control spring-back, and formability and shape accuracy have consequently tended to be poor. And it has been a further problem that in cases where the product has not a simple flat flange but a bent-back flange it is not possible to carry out forming of this flange part.

DISCLOSURE OF THE INVENTION

It is therefore a first object of the invention to provide a dieless forming apparatus of a relatively simple construction with which it is possible to form to a high accuracy from a metal or nonmetal sheet a large three-dimensional product having a bottom with a complex profile and a large area and having a side wall part which is vertical or at a near-vertical angle.

It is a second object of the invention to provide a dieless forming apparatus with which the whole of a sheet is moved correctly in a balanced manner and therefore it is possible to form to a high shape accuracy a large product having a complex shape and a high side wall.

It is a third object of the invention to provide a dieless forming apparatus with which it is possible to carry out forming with good formability and precision by freely managing changes in sheet thickness and it is possible for example to form a product having a vertical or near-vertical side wall with good accuracy by suppressing reductions in sheet thickness or conversely to form a product whose angles to the horizontal are small with good accuracy by suppressing creasing deformation of the sheet material.

And it is further object of the invention to provide a dieless forming apparatus with which it is possible easily to form a product having a flange with a bent-back portion.

A dieless forming apparatus provided by the invention to achieve the above-mentioned first object is an apparatus for progressively forming a sheet into a three-dimensional shape, and comprises a tool set having a base plate, a fixed pressing assembly, a sheet holding mechanism and a sheet restraining mechanism; a pressing mechanism cooperating with the tool set; and a plurality of numerically controlled drive devices for moving the tool set and the pressing mechanism with respect to each other in X-axis, Y-axis and Z-axis directions.

The fixed pressing assembly has a stand erected on the base plate and a ceiling plate form having a plane shape matching the bottom profile of a product to be formed and interchangeably attached to the top of the stand, and the sheet holding mechanism has a plurality of support pillars mounted on the base plate, a support plate having a window hole surrounding the ceiling plate form and movable in the Z-axis direction on the support pillars, and at Least a pair of raising/lowering actuators fixed to the base plate and having output end parts connected to the support plate.

The sheet restraining mechanism has a framelike restraining plate for clamping the periphery of the sheet in the sheet thickness direction between itself and the support plate and restraining actuators for applying a controlled restraining force to the periphery of the sheet by way of the restraining plate.

The pressing mechanism has at a distal end thereof a pressing tool part for making contact with the upper side of the sheet and forming a product shape in cooperation with the ceiling plate form.

The numerically controlled drive devices are program-controlled to press the pressing tool part against the sheet and move it in this state around the ceiling plate form along a path matching the product shape and also to move the pressing mechanism and the support plate in the plate thickness direction with respect to the ceiling plate form.

With this construction, by means of the cooperative action of the ceiling plate form having a plane shape matching the bottom profile of the product to be formed and the restraining actuators, it is possible to form easily from a sheet a product having a bottom which has a large area of for example about 6 $m^2$ and also has a complex profile other than a simple polygonal or circular shape, a sharp corner, and a high side wall part continuing at a steep angle from this corner.

Also, because by means of the raising/lowering actuators it is possible to forcibly move the support plate in a forming direction (downward) or an opposite direction (sideward) during progressive forming, sheets of various properties and thicknesses can be formed in an optimal state and can be formed with good accuracy without cracking or deformation of the side wall part occurring.

In an apparatus provided by the invention to achieve the above-mentioned second object, in addition to the construction described above, the sheet holding mechanism is provided with a balanced movement mechanism for causing the support plate to maintain horizontality and undergo parallel displacement together with the support pillars. This balanced movement mechanism may preferably be made up of racks provided on the support pillars, pinions mounted on the base plate in the proximities of the support pillars and meshing with the racks of the support pillars, and rotation-synchronizing shafts linking together shafts of these pinions.

With this construction, the raising/lowering actuators function as balance cylinders canceling out the weight of the support plate, the sheet and the sheet restraining mechanism; an excessive weight does not act on any of the support pillars supporting the support plate; and because the pinions meshing with the racks of the support pillars always rotate by the same amount due to the twisting rigidity of the rotation-synchronizing shafts, all of the support pillars always ascend and descend by equal amounts. Therefore, the support plate can be made to undergo parallel displacement smoothly with respect to the base plate. As a result, it is possible to form with high accuracy a large three-dimensional product for example having dimensions, including a flange, of 6000×2000×600 mm (600 mm being the height) and a bottom area of 6.6 $m^2$.

And because the raising/lowering actuators can forcibly pull the support plate and hence the sheet in the forming direction (downward) or push it in the opposite direction (upward), it is possible to increase forming limits and widen the range of shapes of which forming is possible. In particular, when hydraulic cylinders are used as the raising/lowering actuators and hydraulic pressure supply control is carried out by means of a hydraulic servo valve, it is possible to freely adjust a pulling-down or pushing-up pressure on the support plate (pressure control) and carry out exact control of the height position, including position holding, of the support plate (position control). Therefore, higher side walls can be formed and it is possible to form an accurate product whether the sheet is thick or thin.

In the invention, the balanced movement mechanism includes mechanisms wherein, in addition to racks provided on the support pillars and pinions mounted on the base plate in the proximities of the support pillars and meshing with the racks of the respective support pillars and rotation-synchronizing shafts linking together shafts of these pinions, the rotation-synchronizing shafts themselves have a rotary drive device.

When this construction is employed, because the raising/lowering actuators function as balance cylinders canceling out the weight of the support plate, the sheet and the sheet restraining mechanism, the support plate can be made to undergo parallel displacement without an excessive load being applied to any of the support pillars supporting the support plate. Furthermore, by using a numerically controlled motor, for example an a.c. servo motor, as the rotary drive device, it is possible to adjust the height position of the support plate freely and with good precision by means of torque control. As a result, in addition to the maximum height of side wall that can be formed increasing and it being possible to form an accurate product whether the sheet is thick or thin, by operating the rotary drive device and thereby deliberately lowering the support plate before or during progressive forming, it is possible to utilize the profile of the ceiling plate form of the fixed pressing assembly to constrict the sheet. Thus by this means also a higher side wall can be formed and it is possible to form an accurate product whether the sheet is thick or thin.

In an apparatus provided by the invention to achieve the above-mentioned third object, the sheet holding mechanism is additionally provided with a material flow control mechanism. This material flow control mechanism has a plurality of shifting actuators disposed around the periphery of the support plate and jigs for forcibly pushing the sheet in toward a forming area during forming by operation of these shifting actuators.

With this construction, in addition to the action of the restraining actuators applying a controlled restraining force to the sheet periphery by way of the restraining plate, during progressive forming it is possible by means of operation of the shifting actuators to actively supply a peripheral portion of the sheet to an area where forming is being carried out by the pressing tool part. Thus it is possible to reduce excessive elongation of the material and the degree of consequent decreasing of the sheet thickness. As a result it is possible to manufacture a product having at least at some part thereof a side wall which is vertical or at a near-vertical steep angle, for example a boat or a bath tub, easily and with good accuracy, and the strength of the product can also be made good. Numerically controlled actuators are preferable, and because by means of these it is possible to control push-in positions and push-in pressures exactly, it is possible to effect flow of the material to the forming area taking into account the thickness, material and mechanical characteristics of the sheet.

The material flow control mechanism may have a plurality of shifting actuators disposed at the periphery of the support plate and jigs for forcibly pulling the sheet outward during forming by operation of these shifting actuators.

With this construction, when making a product having the shape of a flat-bottomed boat with at least at some part thereof a side wall whose angle to the horizontal is relatively small, for example 14° or less, it is possible to prevent material becoming surplus and creasing as a result of the pushing movement of the pressing tool part, and an accurate shape can be formed.

In the invention, because the ceiling plate form of the fixed pressing assembly has a plane shape matching the bottom profile of the product to be formed, using this ceiling plate form it is possible to make a product having any kind of bottom shape. And because the ceiling plate form is attached to the top of the stand interchangeably, it is possible to form products of various different shapes just by changing the ceiling plate form for ones of different shapes while keeping the same base plate and sheet holding mechanism and sheet restraining mechanism. This ceiling plate form does not have to beading plate. That is, it may be made up of a plurality of plates spaced in the height direction or in the horizontal direction, and by this means it is possible to form easily and efficiently a product of a complex shape having a plurality of bottoms.

The sheet holding mechanism of the invention may have an auxiliary support plate, that is, a plate having an annular step face around a window hole for allowing the ceiling plate form to pass through or having a step face forming a groove in the proximity of a window hole for allowing the ceiling plate form to pass through. When this auxiliary support plate is placed on the support plate and fixed integrally thereto it is possible to form a product having a bent-back annular flange accurately and easily by means of a cooperative action of the auxiliary support plate with the pressing tool part.

The invention also includes versions wherein the pressing tool part of the pressing mechanism consists of a freely rotatable spherical member and versions wherein the pressing mechanism further has a lubricating hole for supplying lubricant to the spherical member.

With this construction, the spherical member is rotated by friction between itself and the sheet as the pressing tool part moves at a constant height while pressing the sheet, and the friction between the pressing tool part and the sheet becomes rolling friction instead of sliding friction. As a result, because the coefficient of this friction and the heat it produces are suppressed, it is possible to increase forming speeds and also suppress spring-back.

The invention also includes versions wherein the pressing mechanism is rotatable about its own axis and has at its lower end a pressing tool part which is eccentric from the shaft center of the pressing mechanism. With this construction, because the pressing tool part not only presses the sheet but also oscillates in the cross direction and beats the material, local plastic deformation is induced effectively and spring-back after forming is thereby suppressed.

In the invention, because a forming process wherein the pressing tool part is moved at constant heights and the sheet is moved relative to the ceiling plate form is adopted, it is essential that the tool set, made up of the base plate and the sheet holding mechanism, the fixed pressing assembly, the sheet restraining mechanism and the balanced movement mechanism and so on thereon, and the pressing mechanism above this are moved with respect to each other in X-axis, Y-axis and Z-axis directions.

In a first preferred embodiment for achieving this, tables of two stages supporting the tool set are provided on a bed, these tables are moved in X-axis and Y-axis directions by drive devices, and the pressing mechanism is mounted on a slider mounted on a gate-shaped frame above the bed and moved in a Z-axis direction by another drive device.

This configuration has the merits that the construction is relatively simple and because the weight of the lower part is large the stability of the construction is good, and the configuration is suitable for the forming of sheets of up to about 1300×1800 mm in size.

In a second preferred embodiment, a single-stage table supports the tool set on a bed, this table is moved by a drive device in one direction, an X-axis or Y-axis direction, and the pressing mechanism is mounted by way of a slider on a table mounted on a gate-shaped frame above the bed and moved by drive devices in two directions, an Y-axis or X-axis direction and a Z-axis direction. This configuration has the merit that the height of the apparatus can be made low.

In a third preferred embodiment, a gantry frame is provided above a bed, a table movable by a drive device in an X-axis direction is mounted on the gantry frame, a second table movable by a drive device in a Y-axis direction is mounted on the first table, a slider movable by a drive device in a Z-axis direction is mounted on this second table, the pressing mechanism is mounted on the slider, and the tool set is installed on the bed.

With this configuration, because the pressing mechanism moves in X-axis, Y-axis and Z-axis directions and the tool set is stationary, there is the merit that large inertia forces and stopping shocks caused by the heavy tool set being moved at high speeds are eliminated, stopping accuracy improves and high-speed movement is possible without shocks occurring.

In a fourth preferred embodiment, a gantry frame is provided above a bed, a table movable by a drive device in an X-axis direction is mounted on the gantry frame, a second table movable by a drive device in a Y-axis direction is mounted on the first table, the pressing mechanism is mounted on the second table, a third table movable by a drive device in a Z-axis direction is provided on the bed, and the tool set is mounted on this third table.

With this configuration, the pressing mechanism moves in the X-axis and Y-axis directions and the tool set is only moved in the Z-axis direction. Because during progressive forming the height position of the tool set is fixed while the pressing tool part of the pressing mechanism is moving at a constant height, with this configuration there is the merit that large inertia forces and stopping shocks caused by the heavy tool set being moved at high speeds in the X-axis and Y-axis directions are eliminated, stopping accuracy improves and high-speed movement is possible without shocks occurring.

Other features and advantages of the invention will become clear from the following detailed description of presently preferred embodiments. It should be understood, however, that the invention is not limited to the preferred embodiments given below, and various changes and modifications within the spirit and scope of the invention will become apparent to those skilled in the art from this detailed description.

BRIEF DESCRIPTION OF THE DRAWINGS

FIG. 17-A is a side view showing detail of an example of a fixed pressing assembly of the invention;

FIG. 17-B is a side view showing detail of another example of a fixed pressing assembly of the invention;

FIG. 18-A is a side view showing detail of another example of a fixed pressing assembly usable in the invention;

FIG. 18-B is a side view showing detail of another example of a fixed pressing assembly usable in the invention;

FIG. 19 is a side view of an example of a sheet restraining mechanism of the invention;

FIG. 22-A is a side view of a first example of a pressing mechanism of the invention;

FIG. 22-B is a side view of a second example of a pressing mechanism of the invention;

FIG. 22-C is a side view of a third example of a pressing mechanism of the invention;

FIG. 23-A is a side view of a fourth example of a pressing mechanism of the invention in use;

FIG. 23-B is an enlarged view of a detail of FIG. 24-A;

FIG. 25-A is a front view showing a state at the start of forming taking the first preferred embodiment as an example;

FIG. 25-B is a front view showing a state near the end of forming;

FIG. 26 is a perspective view showing a state during forming;

FIG. 27-A is a perspective view showing an example of a fixed pressing assembly in the invention;

FIG. 27-B is a perspective view showing a product made using the same fixed pressing assembly;

FIG. 28-A is a perspective view showing another example of a fixed pressing assembly in the invention;

FIG. 28-B is a perspective view of a product made using the same fixed pressing assembly;

FIG. 29-A is a perspective view showing another example of a fixed pressing assembly in the invention;

FIG. 29-B is a perspective view of a product made using the same fixed pressing assembly;

FIG. 30-A is a perspective view showing another example of a fixed pressing assembly in the invention;

FIG. 30-B is a perspective view of a product made using the same fixed pressing assembly;

FIG. 31-A is a perspective view showing another example of a fixed pressing assembly in the invention;

FIG. 31-B is a sectional view showing a state during forming with this fixed pressing assembly;

FIG. 31-C is a perspective view of a product made using the same fixed pressing assembly;

FIG. 32-A is a perspective view of an example of a product (a boat-shaped forming) in the invention;

FIG. 32-B is a front view of the same product example;

FIG. 32-C is a plan view showing a relationship between a sheet shape and forming control forces;

FIG. 32-D is a plan view showing a forming setup;

FIG. 33-A is a perspective view of another example product;

FIG. 33-B is a plan view showing a relationship between a sheet shape and forming control forces;

FIG. 33-C is a plan view showing a forming setup;

FIG. 34-A is a sectional view showing a material flow control mechanism of the invention in use;

FIG. 34-B is a sectional view showing a material flow control mechanism of the invention in use;

FIG. 35-A is a perspective view showing an example of a flanged product formed using the invention;

FIG. 35-B is a partial sectional view of the same;

FIG. 35-C is a perspective view showing an example of an auxiliary support plate for forming the product shown in FIG. 35-A;

FIG. 35-D is a sectional view showing a corresponding forming setup;

FIG. 35-E is an enlarged view of a detail of FIG. 35-D;

FIG. 36-A is a perspective view showing another example of an auxiliary support plate for forming a flanged product;

FIG. 36-B is a sectional view showing a corresponding forming setup;

FIG. 37-A is a sectional view showing means for preventing spring-back and deformation of a bottom part, and a forming setup using the same;

FIG. 37-B is a plan view corresponding to FIG. 37-A;

FIG. 38-A is a sectional view showing a preferred embodiment of the invention having a lubricating mechanism; and FIG. 38-B is a partial plan view of the same.

DETAILED DESCRIPTION OF THE INVENTION

Preferred embodiments of the invention will now be described on the basis of the accompanying drawings. The following first through fourth preferred embodiments are X, Y, Z-axis movement type dieless forming apparatuses.

Figure 1:
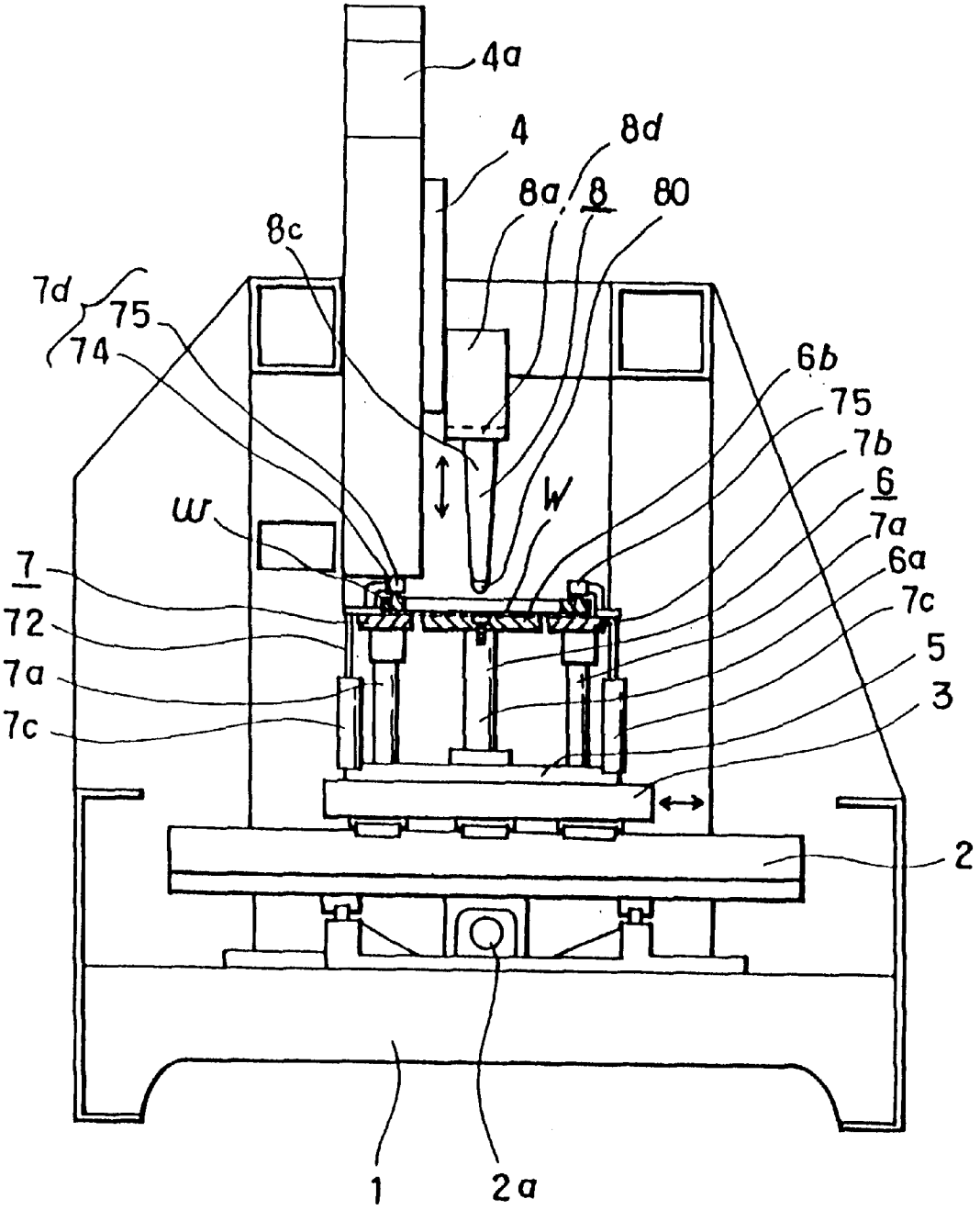
FIG. 1 is a side view of a first preferred embodiment of the invention.
Figure 2:
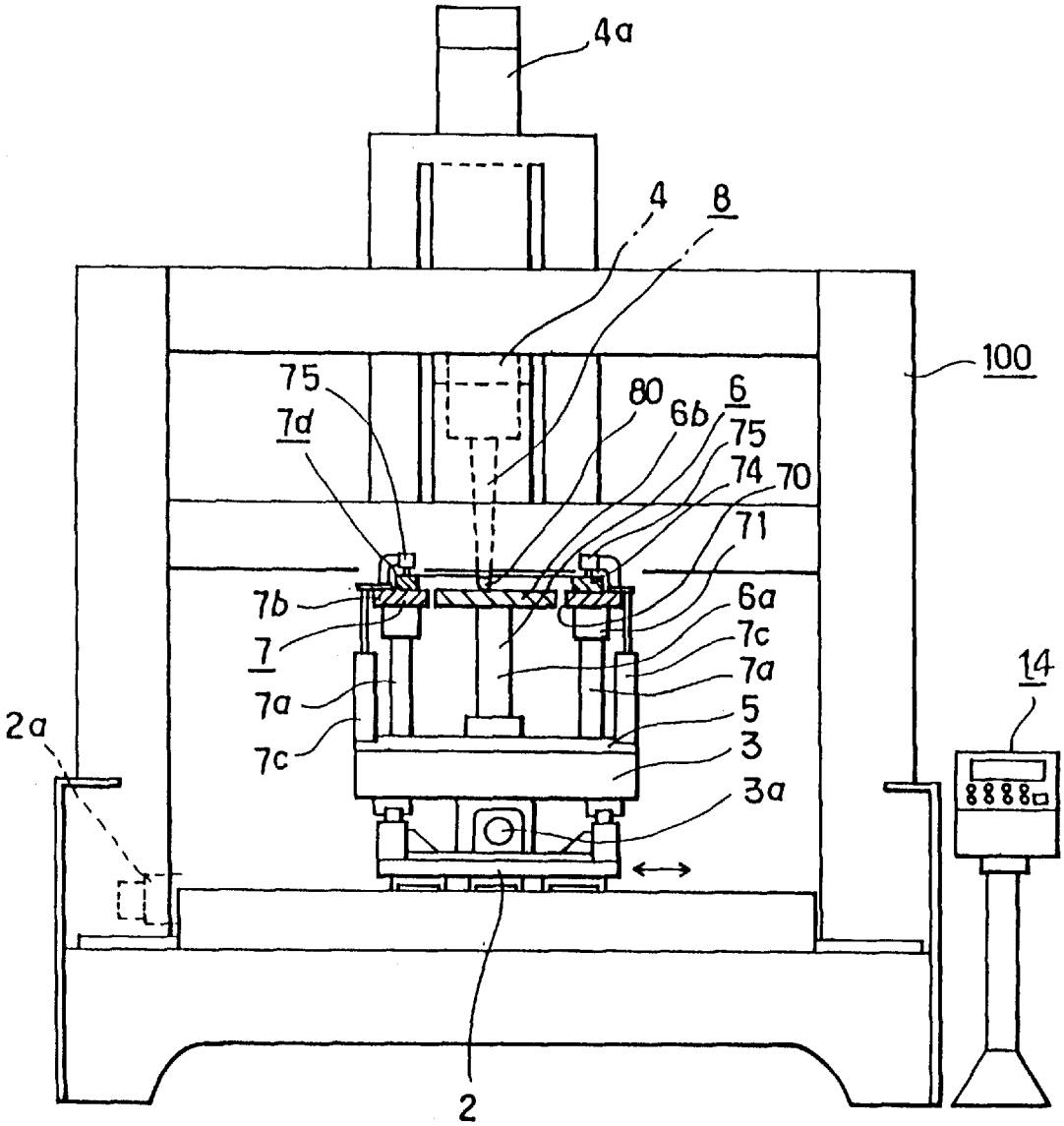
FIG. 2 is a front view of the first preferred embodiment.
Figure 3:
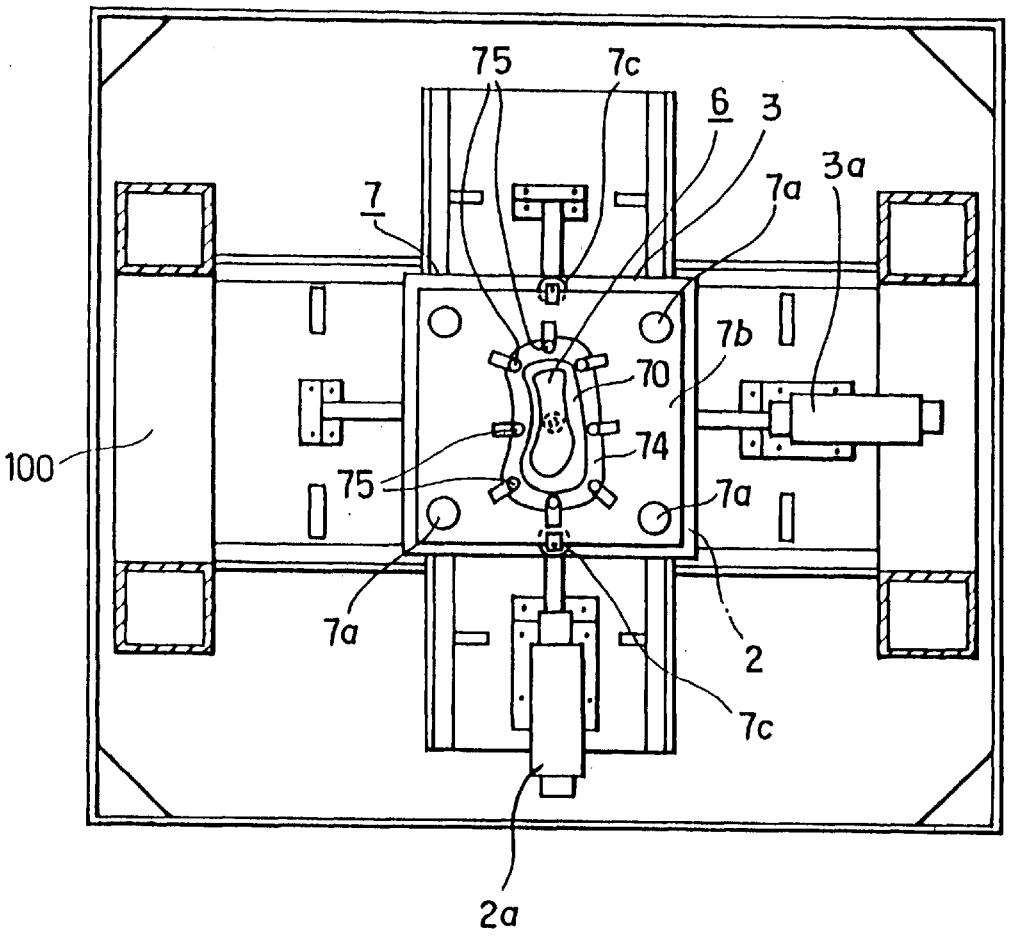
FIG. 3 is a cross-sectional view of the first preferred embodiment.

FIG. 1 through FIG. 3 show a first preferred embodiment of a dieless forming apparatus according to the invention.

The reference numeral 1 denotes a bed (bed frame) mounted on a plinth; 2 a first table mounted on the bed 1 and movable in a horizontal direction and 3 a second table mounted on the first table 2 and movable in a horizontal direction orthogonal to the direction of movement of the first table 2. These first and second tables 2, 3 are respectively moved by numerically controlled drive devices (drive actuators) 2*a*, 3*a* such as a.c. servo motors or linear motors.

A slider 4 is mounted on a gate-shaped frame 100 fixed to the bed 1 and is moved by a numerically controlled drive device (drive actuator) 4*a* such as an a.c. servo motor or a linear motor in a direction.

A base plate 5 is fixed to the top of the second table 3, and a fixed pressing assembly 6 is mounted on a central part of the base plate 5.

The fixed pressing assembly 6 has a stand 6*a* fixed to the base plate 5 and attached to the top of this a ceiling plate form 6*b* having a plane shape matching the bottom profile of a product to be formed.

A holding mechanism 7 is made up of a plurality of support pillars 7*a* mounted on the base plate 5 radially outward of the stand 6*a* of the fixed pressing assembly 6, a support plate 7*b* disposed on the support pillars 7*a*, and at least one pair of raising/lowering actuators 7*c*, 7*c* fixed to the base plate 5 and having output parts 72 with upper ends connected to the support plate 7*a*.

The support plate 7*b* is means for supporting a sheet workpiece W of which forming is to be carried out and is shaped like a frame having a window hole 70 somewhat larger than the external profile dimensions of the ceiling plate form 6*b*. In this example, because the support pillars 7*a* do not move, the support plate 7*b* has cylindrical parts 71 on which it can slide along the support pillars 7*a*.

The raising/lowering actuators 7*c*, 7*c* are fluid pressure cylinders operated by air or oil pressure, and in this preferred embodiment the support plate 7*b* can be pushed up to the same level as the ceiling plate form 6*b* or pulled down from this state to a level below that of the ceiling plate form 6*b* by the raising/lowering actuators 7*c*, 7*c*.

A sheet restraining mechanism 7*d* for clamping a peripheral portion (flange portion) w of the sheet workpiece W between itself and the support plate 7*b* is provided on the support plate 7*b*. The sheet restraining mechanism 7*d* has a frame-shaped restraining plate 74 which makes contact with the upper side of the peripheral portion of the sheet workpiece W and a plurality of restraining actuators 75 for applying a controlled pressing force to the sheet periphery by way of the restraining plate 74. These elements on the base plate 5 constitute a tool set.

A pressing mechanism 8 functions as a tool for carrying out progressive forming in cooperation with the ceiling plate form 6*b* of the fixed pressing assembly 6. In this example the pressing mechanism 8 has a shaft part 8*c* interchangeably attached to a holder 8*a* fixed to the slider 4 and is moved in a Z-axis direction (the vertical direction) by the slider 4 being moved by the drive device 4*a*. The shaft part 8*c* has at a lower end thereof a curved pressing tool part 80 for making contact with the sheet workpiece W and carrying out forming.

A progressive forming control unit 14 includes a controller for controlling the operations of various driving means such as the drive devices 2*a*, 3*a* and 4*a*, the raising/lowering actuators 7*c*, 7*c* and the restraining actuators 7*d*, 7*d*. The control system will be further discussed later.

Figure 4:
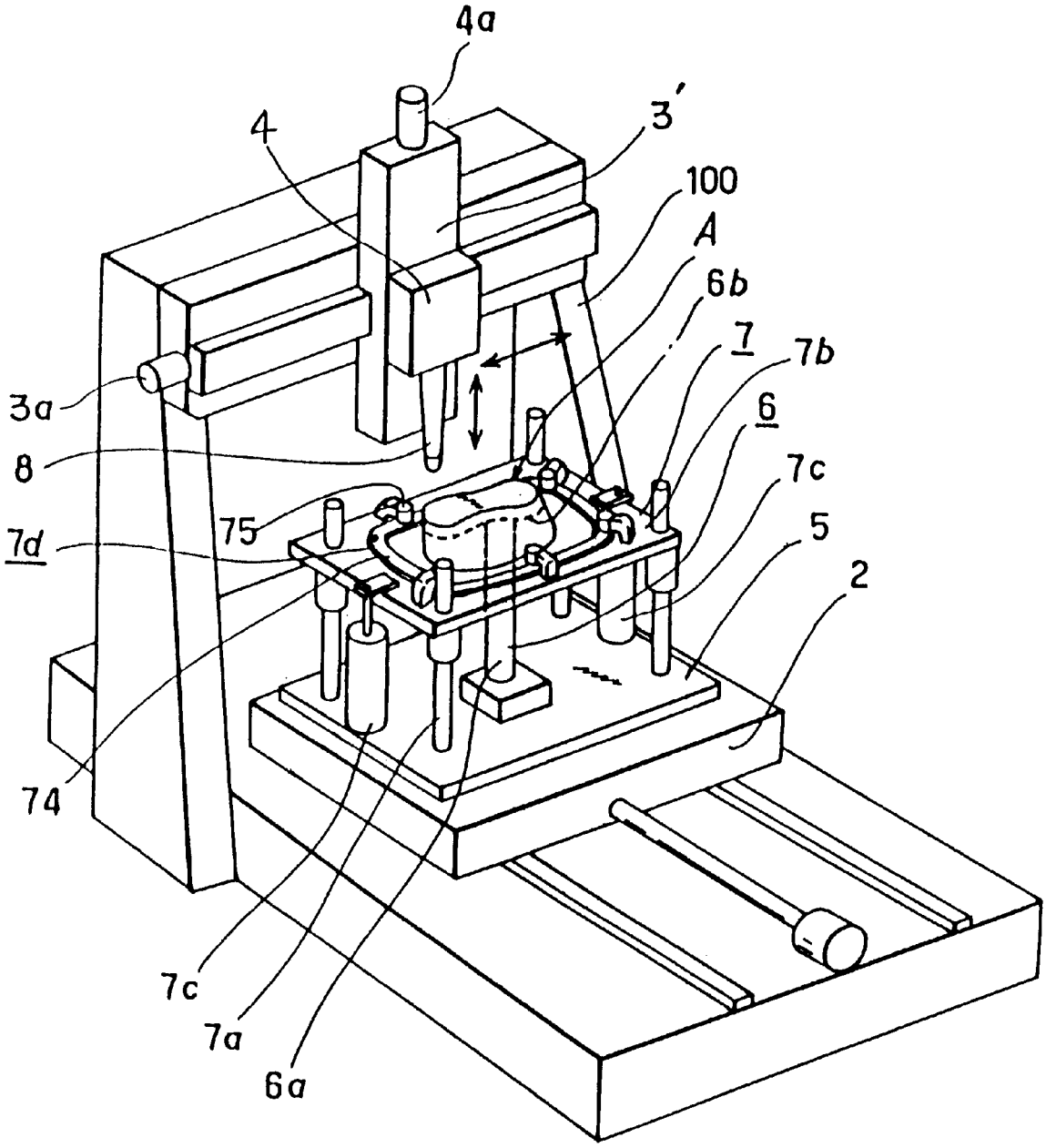
FIG. 4 is a perspective view of a second preferred embodiment.

FIG. 4 shows a second preferred embodiment of the invention. In this preferred embodiment, a single first table 2 is provided on a bed 1, a base plate 5 is fixed to this in the same way as in the first preferred embodiment, and a tool set of the kind described above is provided on this base plate 5.

A table 3' is provided on a gate-shaped frame 100 mounted on the bed 1, and a slider 4 fitted with a pressing mechanism 8 is fitted to this table 3'.

The direction of movement of the table 3' is a direction orthogonal to that of the first table 2, i.e. the Y-axis direction if the movement direction of the table 2 is the X-axis direction, and the table 3' and the slider 4 are respectively moved by numerically controlled drive devices 3*a*, 4*a* such as a.c. servo motors or a linear motors. Thus, in this second preferred embodiment, the pressing mechanism 8 moves in the X-axis (or Y-axis) and Z-axis directions and the base plate 5 and the tool set thereon move in the Y-axis (or X-axis) direction.

The rest of the construction is the same as that of the first preferred embodiment.

Figure 5:
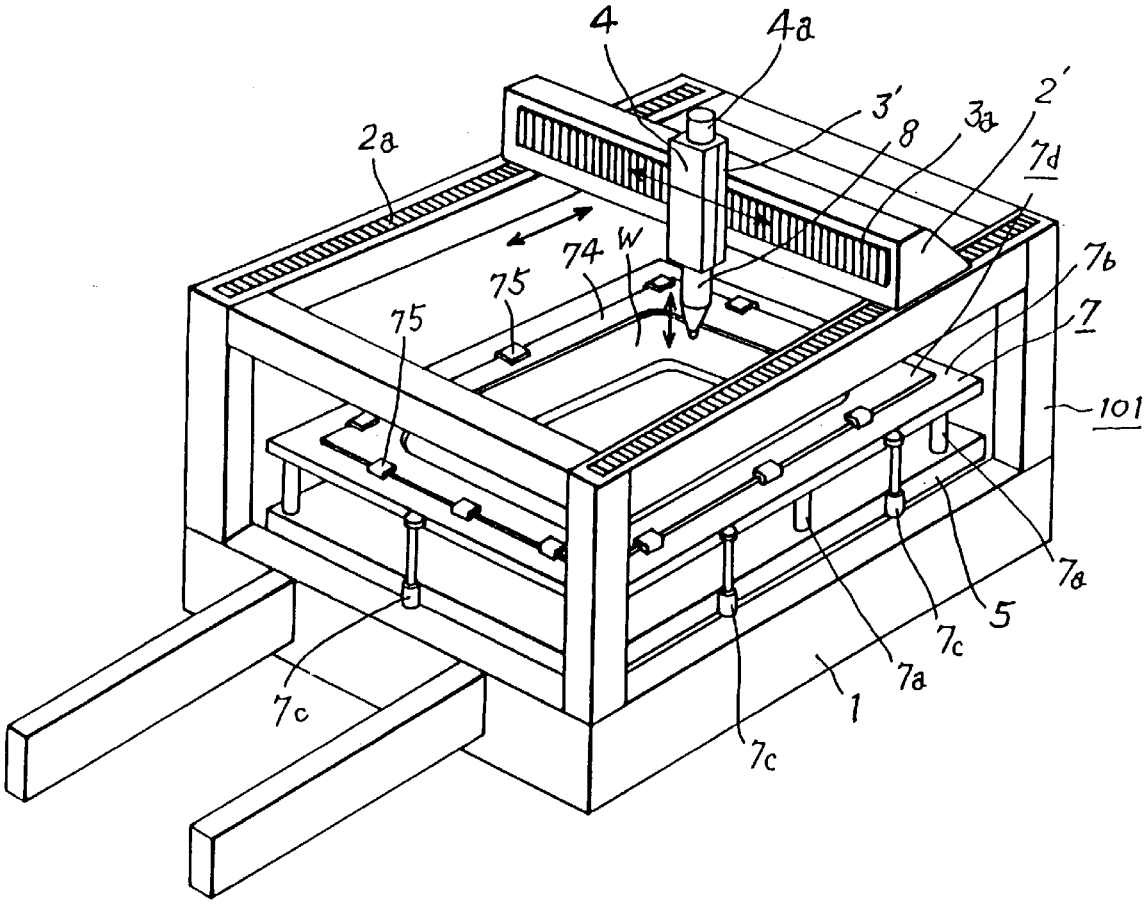
FIG. 5 is a perspective view of a third preferred embodiment.
Figure 6:
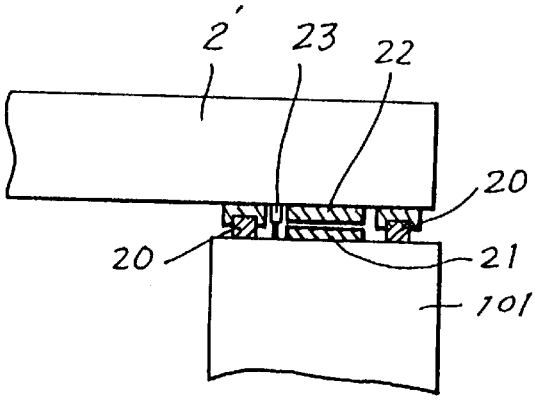
FIG. 6 is a sectional detail view of the third preferred embodiment.

FIG. 5 and FIG. 6 show a third preferred embodiment of the invention. This preferred embodiment is suitable for the manufacture of large products of the kind mentioned earlier of side length for example 6000 mm. In this third preferred embodiment, a gantry frame 101 made up of square columns and rectangular beams rigidly joined to these columns is provided on a bed 1, a table 2' movable in an X-axis direction by a numerically controlled drive device 2*a* extends between two parallel sides of this gantry frame 101, a sliding table 3' movable in a Y-axis direction by a numerically controlled drive device 3*a* is fitted to this table 2', a slider 4 movable in a Z-axis direction by a numerically controlled drive device 4*a* is attached to the table 3', and a pressing mechanism 8 is mounted on the slider 4.

In this example, linear motors are used for the drive devices 2*a* and 3*a*. In FIG. 6, the reference numeral 20 denotes guide rails, 21 a magnet plate, 22 a coil slider, and 23 a linear scale.

In this preferred embodiment, the pressing mechanism 8 moves in three directions, the X-axis, the Y-axis and the Z-axis directions, and accordingly the base plate 5 is fixed to the bed 1 or to a bolster disposed on the bed 1.

The rest of the construction is the same as that of the first preferred embodiment.

Figure 7:
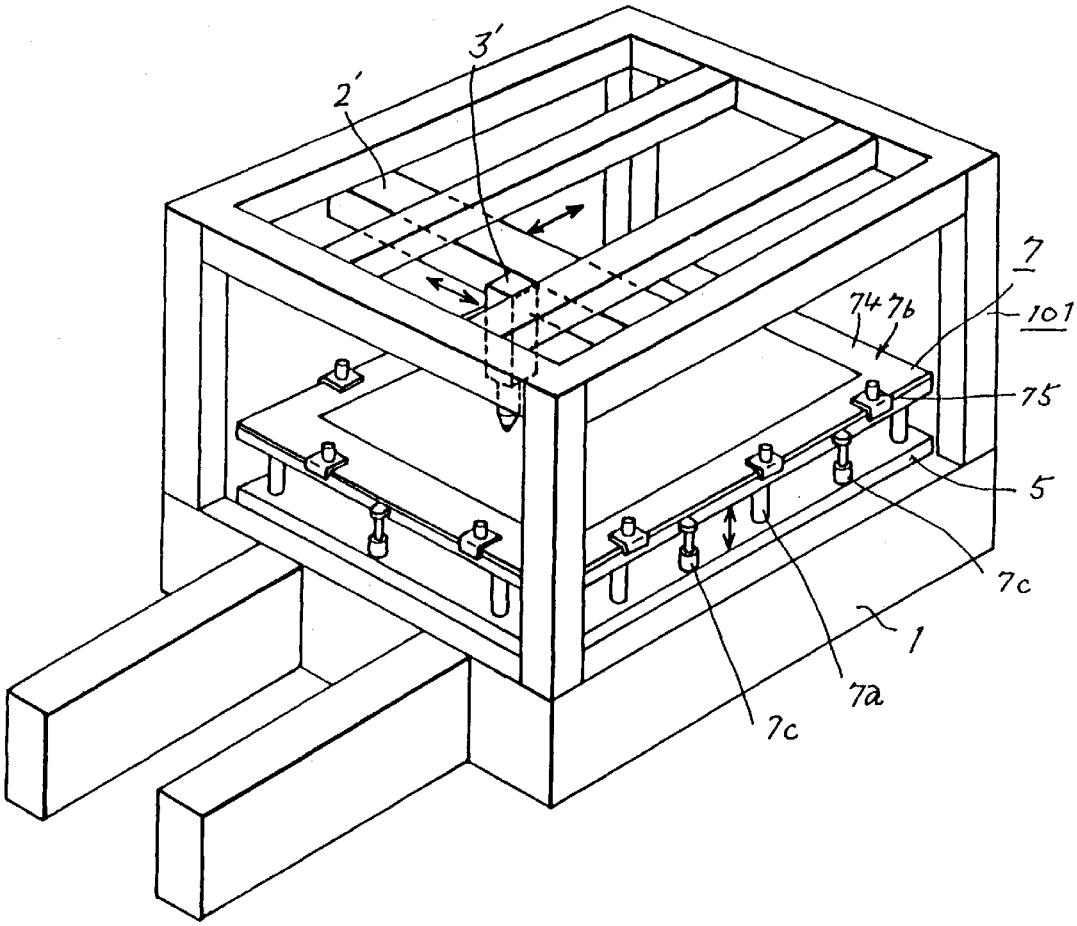
FIG. 7 is a perspective view of a fourth preferred embodiment.
Figure 8:
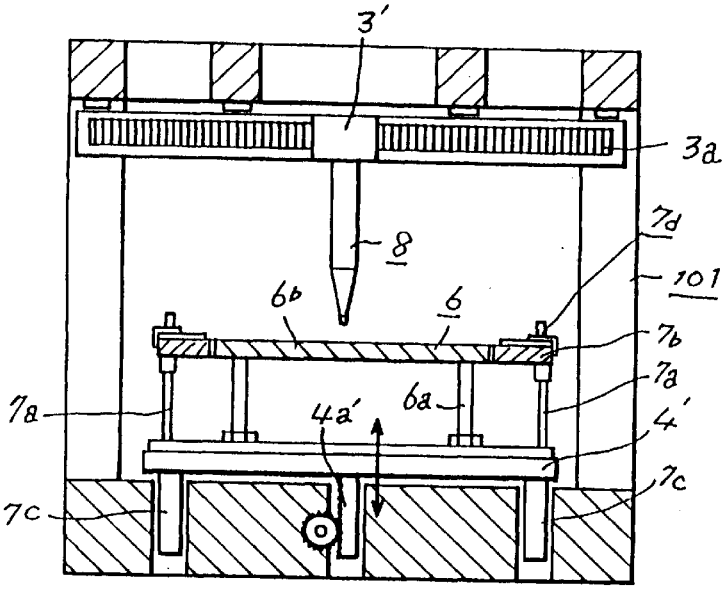
FIG. 8 is a front view of the fourth preferred embodiment.
Figure 9:
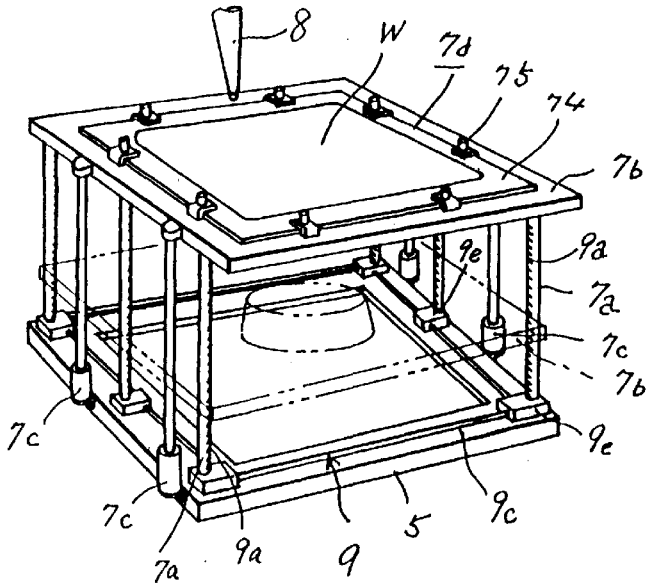
FIG. 9 is a perspective view of a first preferred embodiment of a tool set of the invention.

FIG. 7 and FIG. 8 show a fourth preferred embodiment of the invention.

In this preferred embodiment, a gantry frame 101 made up of square columns and rectangular beams rigidly joined to these columns is provided on a bed 1, a table 2' movable in an X-axis direction by a numerically controlled drive device 2*a* extends between two parallel sides of this gantry frame 101, a sliding table 3' movable in a Y-axis direction by a numerically controlled drive device 3*a* is fitted to this table 2', and a pressing mechanism 8 is mounted on this table 3'.

A table 4' movable in a Z-axis direction by a numerically controlled drive device 4*a* is mounted on the bed 1, and a base plate 5 and a tool set thereon are mounted on the table 4'.

In this example linear motors are used for the drive devices 2*a* and 3*a*, an a.c. servo motor and a pinion driven by this are used for the drive device 4*a'*, and a rack meshing with the pinion is used for the table 4'. Of course, a ball and screw arrangement may alternatively be used.

In this preferred embodiment the pressing mechanism 8 moves in two directions, an X-axis direction and a Y-axis direction, and the base plate 5 and the tool set thereon moves in a Z-axis direction.

The rest of the construction is the same as that of the first preferred embodiment.

FIG. 9 through FIG. 16 show tool sets suitable for use in the invention, and a characteristic of these is that they each have a balanced movement mechanism 9 for balancing movement of the support plate 7*b* and thus the sheet workpiece. The tool sets of FIG. 9 through FIG. 16 are used selectively in the first through fourth preferred embodiments described above.

FIG. 9 through FIG. 12 show a first preferred embodiment of a tool set having a balanced movement mechanism 9.

Figure 10:
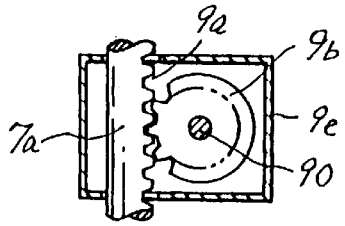
FIG. 10 is a sectional view of a detail of FIG. 9.

Gearboxes 9*e* having built-in pinions 9*b* of the kind shown in FIG. 10 are fixed to the base plate 5 at the positions of the support pillars 7*a*; the support pillars 7*a* have a length such that they can extend through the gearboxes 9*e* into guide holes in the base plate 5, and are each provided on one side thereof with a rack 9*a* for meshing with the respective pinion 9*b*. The upper ends of the support pillars 7*a* are connected to the support plate 7*b*, and when a pressing force acts on the support plate 7*b* in the Z-axis direction the support pillars 7*a* move up or down with their racks 9*a* rotating their respective pinions 9*b*.

Figure 12:
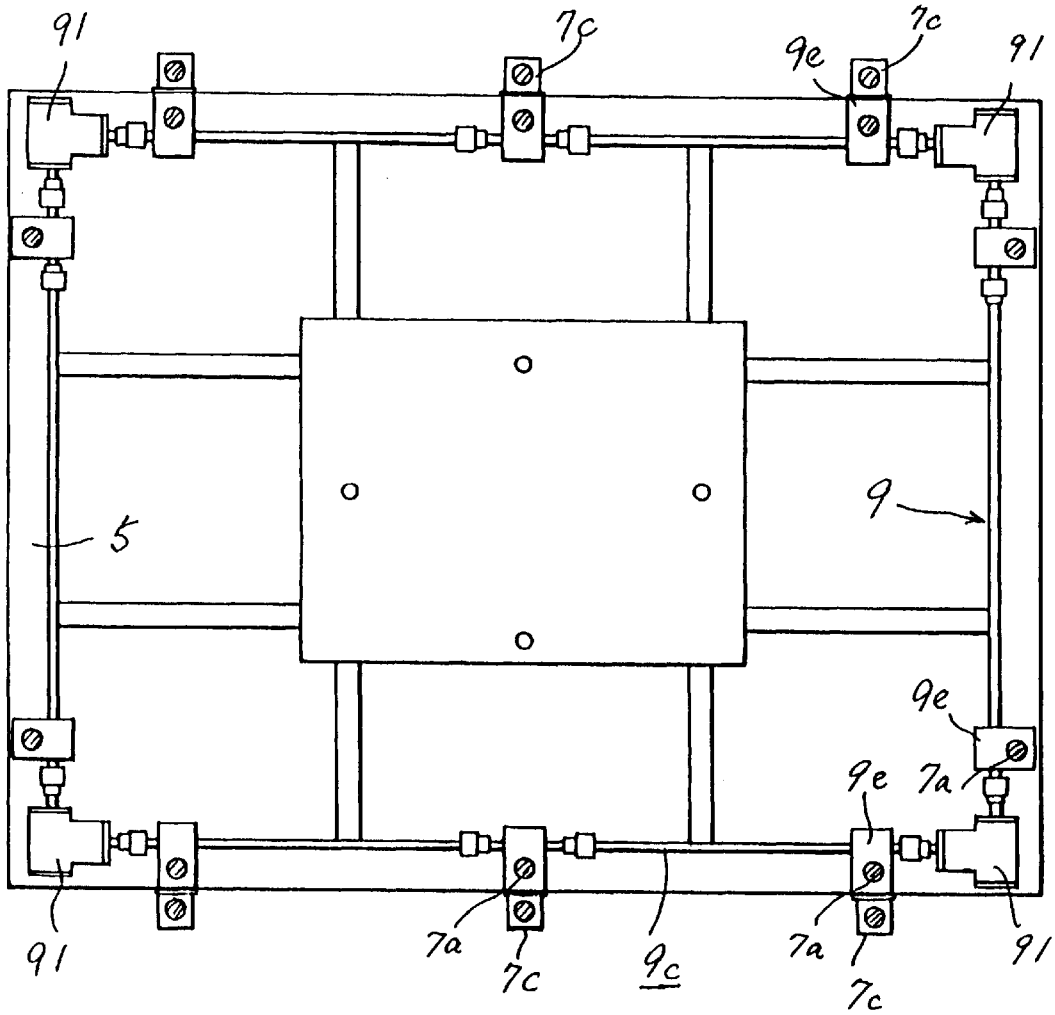
FIG. 12 is a cross-sectional view of the first preferred embodiment of the tool set.

Shafts 90 of the pinions 9*b* pass through the gearboxes 9*e*, and these shafts 90 are connected by rotation-synchronizing shafts 9*c* disposed on the base plate 5. The rotation-synchronizing shafts 9*c* are connected in gearboxes 91 by for example bevel gears so as to collectively form a rectangular shape, as shown in FIG. 12. Thus the pinions 9*b* meshing with the racks 9*a* of the support pillars 7*a* always rotate in synchrony; all of the support pillars 7*a* descend or ascend by equal amounts, and the support plate 7*b* undergoes parallel displacement with its horizontality maintained.

Figure 11:
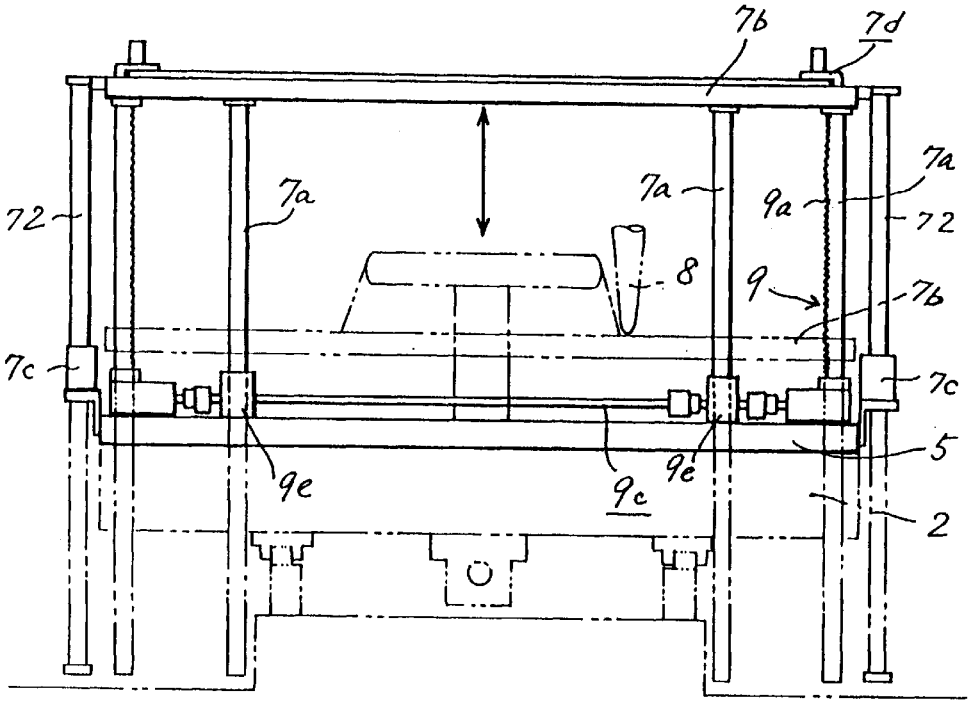
FIG. 11 is a side view of the first preferred embodiment of the tool set.

Although ordinary fluid pressure cylinders can be used for the raising/lowering actuators 7*c*, 7*c*, in this example magnetic rodless cylinders are used; casings thereof are fixed to the base plate 5, and tubes 72 serving as output parts thereof have upper ends fixed to the support plate 7*b* and lower ends extending to below the base plate 5, as shown in FIG. 11. When these magnetic rodless cylinders are used, there is the advantage that a large holding force can be realized with a compact construction.

Figure 13:
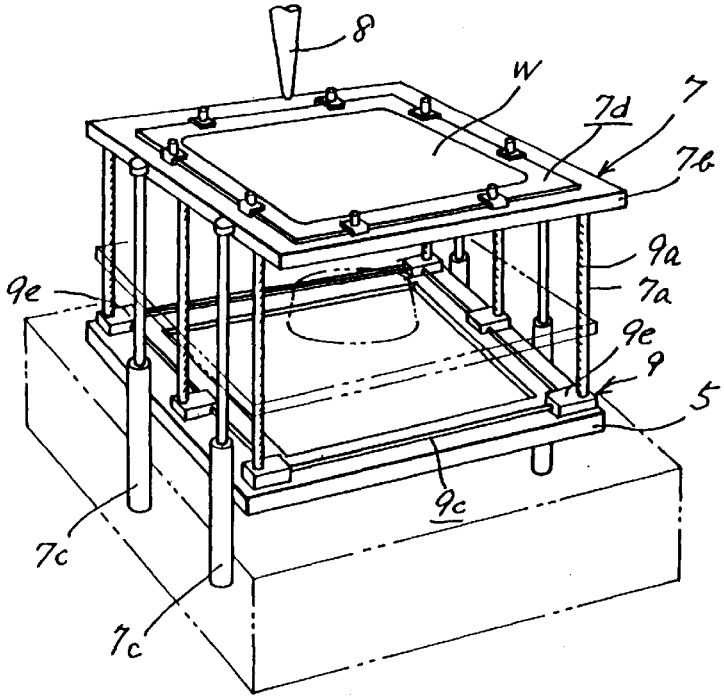
FIG. 13 is a perspective view of a second preferred embodiment of the tool set.
Figure 14:
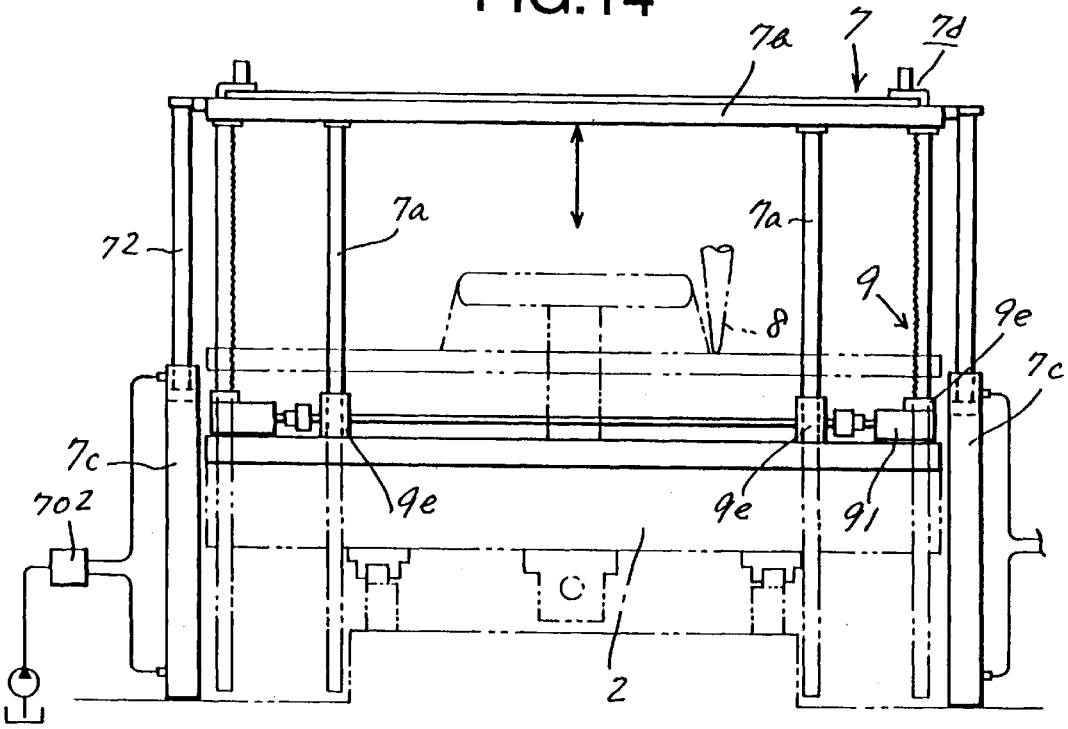
FIG. 14 is a side view of the second preferred embodiment of the tool set.

FIG. 13 and FIG. 14 show a second version of a tool set having a balanced movement mechanism 9. In this version also the construction of the balanced movement mechanism 9 is the same as that shown in FIG. 9 through FIG. 12; however, numerically controlled hydraulic cylinders controlled by hydraulic servo valves 702 are used as the raising/lowering actuators 7*c*, 7*c* . As a result of these raising/lowering actuators 7*c*, 7*c* being used, in addition to the support plate 7*b* being able to ascend and descend in a parallel fashion, it is possible for a force pulling down or pushing up the support plate 7*b* to be controlled precisely, and the height position of the support plate 7*b* can also be controlled accurately.

Figure 15:
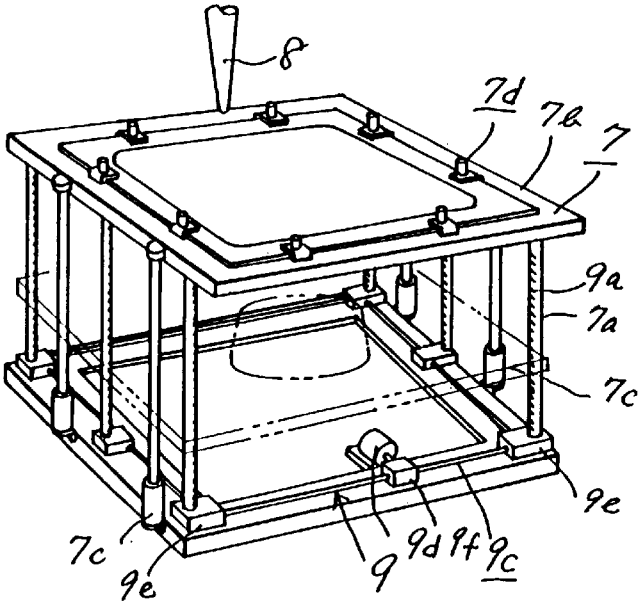
FIG. 15 is a perspective view of a third preferred embodiment of the tool set.
Figure 16:
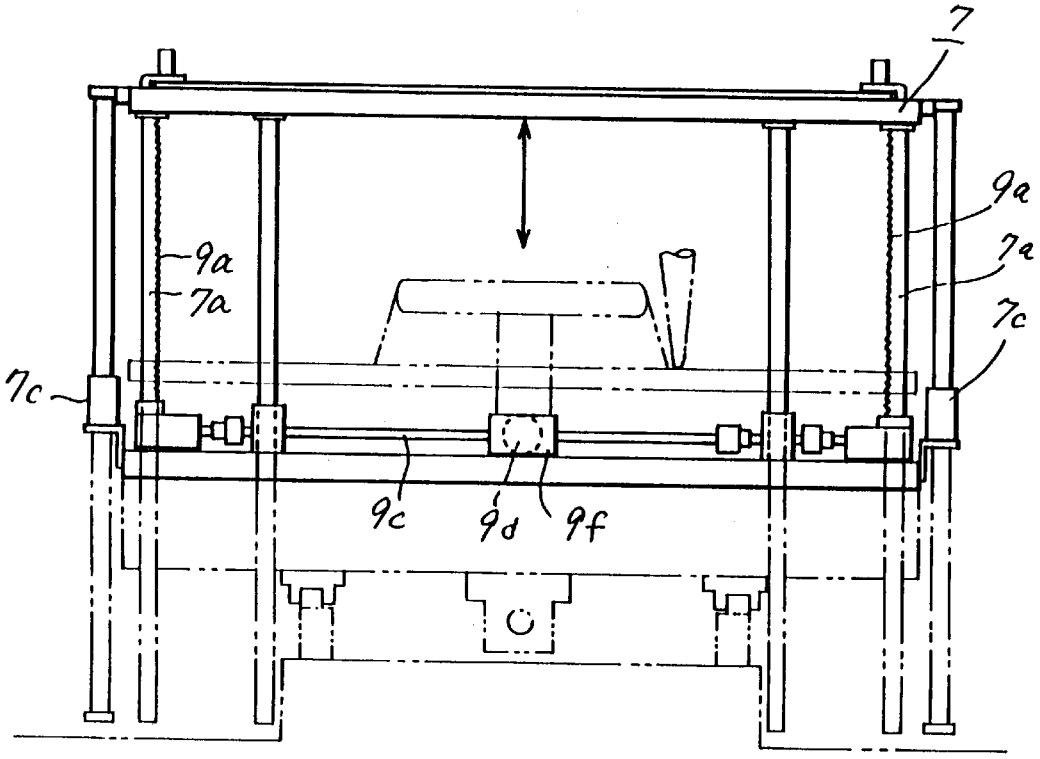
FIG. 16 is a side view of the third preferred embodiment of the tool set.

FIG. 15 and FIG. 16 show a third version of a tool set having a balanced movement mechanism 9. In this version, the balanced movement mechanism 9 constitutes a drive system. That is, a rotary drive device 9*d* is mounted in the proximity of one of the rotation-synchronizing shafts 9*c*, and an output shaft of the rotary drive device 9*d* is connected to this rotation-synchronizing shaft 9*c* by way of a speed-reducer 9*f*.

A numerically controlled actuator such as an a.c. servo motor would normally be used as the rotary drive device 9*d*, although alternatively a hydraulic cylinder may be used to rotate the rotation-synchronizing shafts 9*c* using a rack.

When this rotary drive device 9*d* is provided, all of the pinions 9*b* are synchronously rotated by the operation of the rotary drive device 9*d* by way of the rotation-synchronizing shafts 9*c*, and because the support pillars 7*a* consequently are all made to descend or ascend equally by way of their racks 9*a*, the support plate 7*b* can ascend or descend while maintaining horizontality. Also, by means of output pulse control or torque control of the rotary drive device 9*d* it is possible to carry out accurate control of a pulling-down or pushing-up force on the support plate 7*b* and precise control of the height position of the support plate 7*b*. The raising/lowering actuators 7*c*, 7*c* function as balance cylinders, whereby the weight of the support plate 7*b* and the sheet and the sheet restraining mechanism 7*d* thereon can be canceled out. Therefore, a large load does not act on the support pillars 7*a*.

The fixed pressing assembly 6 will now be discussed.

FIG. 17-A and FIG. 17-B show an example of an attachment structure of the ceiling plate form 6*b* of the fixed pressing assembly 6 in the invention. In FIG. 17-A, a through hole 61 is provided in the ceiling plate form 6*b* in a position corresponding to a female screw hole 60 in the stand 6*a*, and a bolt 62 serving as fixing means is passed through this and screwed into the female screw hole 60 to fix the ceiling plate form 6*b* to the stand 6*a*. In FIG. 17-B, a boss 64 to serve as fixing means is provided on the underside of the ceiling plate form 6*b* and this boss 64 is fitted to the top of the stand 6*a*. The upper face of the ceiling plate form 6*b* does not necessarily have to be flat, and may alternatively be convex or concave.

Particularly when the ceiling plate form 6*b* has a complex shape, a three-dimensional ceiling plate form 6*b* may be used. FIG. 18-A and FIG. 18-B show examples of this, wherein a main part or all of a shape to be formed made of synthetic resin or metal. In each case is attached to the stand 6*a* and thereby fixed to the base plate 5.

FIG. 19 shows an example of a sheet restraining mechanism 7*d*, wherein a restraining actuator 75 is fixed to the support plate 7*b* by a bracket 750. Although a rotary restraining actuator 75 may be used, normally a hydraulic or pneumatic cylinder is used and a piston rod thereof faces the restraining plate 74 and during forming abuts with and applies a force to the restraining plate 74. Pipes connected to a piston side and a rod side of the cylinder are connected to a pressurized fluid supply (not shown) by a pressure control valve 701.

However, the invention is not limited to apparatuses simply having a restraining plate 74 and a plurality of restraining actuators 75 for applying a controlled restraining force to the periphery of the sheet by way of the restraining plate 74, and includes apparatuses having a material flow control mechanism 10 for, during forming, weakening the pressing force applied by the restraining actuators 75 and in this state actively causing the sheet workpiece W to flow into a forming area or, reversely, actively pulling the sheet workpiece W from the forming area. Such a material flow control mechanism 10 is particularly useful in forming a side wall which is vertical or at a near-vertical angle a or forming a side wall having a small angle to the horizontal.

Figure 20:
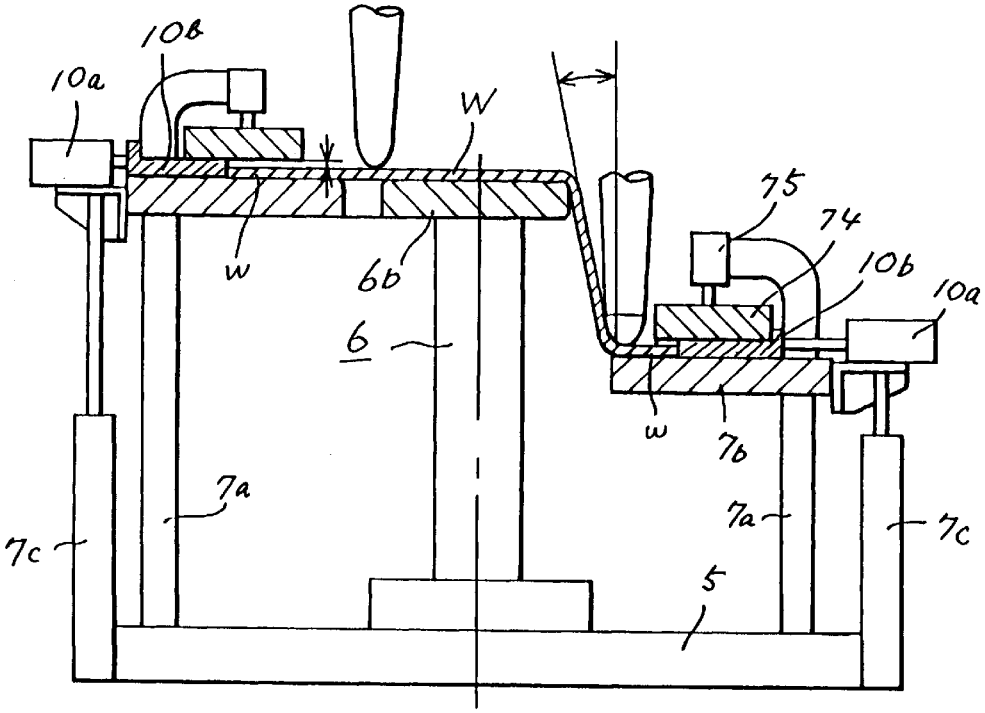
FIG. 20 is a sectional view of a first example of a forming control mechanism of the invention in use.

FIG. 20 shows an example of a material flow control mechanism 10 for actively causing material of a sheet workpiece W to flow into a forming area during forming. A plurality of shifting actuators 10*a* are provided with a predetermined spacing around the periphery of the support plate 7*b* on the outer side of the sheet restraining mechanism 7*d*, and sliding jigs 10*b* for pushing the periphery w of the sheet workpiece W inward are attached to output parts of these shifting actuators 10*a*. The left half of FIG. 20 shows a state preceding the start of forming, and the right half shows an state wherein the periphery w of the sheet workpiece W has been pushed into an area where forming is being carried out by the pressing tool part 80. This prevents the sheet thickness of the side wall part from decreasing. In this example, the jigs 10*b* are made thin sliding plates and move along channels provided in the restraining plate 74 or channels provided in the support plate 7*b*. Distal end faces of the jigs 10*b* abut with and push upon the edge face of the periphery w.

FIG. 22 shows another jig 10*b*'. This jig has upper and lower clamping jaws 105, 105 for clamping the periphery w of the sheet workpiece W, and again can move along a channel provided in the restraining plate 74 or a channel provided in the support plate 7*b*. When this jig 10' is used, the sheet workpiece W can be actively made to flow into the forming area or actively pulled away from the forming area by means of a single type of jig.

The shifting actuator 10*a* may be a hydraulic cylinder or may be a motor. In the former case, a piston rod is connected to the jig 10*b*, 10*b*'. In the latter case, a screw shaft joined to the output shaft of the motor is screwed into a female screw hole in the jig 10*b*, 10*b*'. Although the hydraulic cylinder or motor may be one of on/off-control type, it is a preferably numerically controlled one, for example a hydraulic servo cylinder or an a.c. servo motor; when these are used, the pushing position and pushing force can be controlled to match the forming shape well.

Next, the pressing mechanism 8 will be described in detail.

FIG. 22-A through FIG. 22-C show different versions of the pressing mechanism 8 used in the invention. In FIG. 22-A, the pressing tool part 80 is formed integrally with the distal end of the shaft part 8*c*. FIG. 22-B shows a more preferable type, wherein a spherical concavity is formed in the end of the shaft part 8*c* and a pressing tool part 80 consisting of a hard spherical member such as a bearing ball is freely rotatably fitted in this concavity. FIG. 22-C shows a still more preferable type, wherein the shaft part 8*c* has a lubricating hole 800 connecting with a spherical concavity and a lubricant is supplied through this to a pressing tool part 80 consisting of a spherical member.

When as in FIG. 22-B and FIG. 22-C the pressing tool part 80 is made freely rotatable, because its contact with the sheet material gives rise to rolling friction instead of sliding friction during forming, the production of excessive heat due to friction when a sheet is being formed at high speed can be prevented, and also there is the merit that it is possible to reduce the occurrence of working marks on the product and prevent spring-back of the product.

FIG. 23-A and FIG. 23-B show another version of the pressing mechanism 8 used in the invention, wherein a rotating shaft 8*e* is attached to the holder 8*a* and a shaft part 8*c* fitted with a pressing tool part 80 selected from the examples shown in FIG. 22-A through FIG. 22-C is eccentrically attached to the rotating shaft 8*e*. Any suitable rotating mechanism may be used, and in this example a drive motor is mounted on the holder 8*a* and a pulley on the output shaft thereof is connected by a belt to a pulley fixed to the rotating shaft 8*e*.

When this version shown in FIG. 23-A is employed, in addition to the pressing carried out by the pressing tool part 80, because the shaft part 8*c* rotates eccentrically, it beats the forming area W' as shown in FIG. 23-B, and thereby local plastic deformation is obtained and the occurrence of spring-back after forming is suppressed. Also, lubricity improves and the production of heat due to friction can be reduced.

The invention also includes cases wherein the pressing mechanism 8 has vibrating means 8*d*. This is realized by attaching to the holder 8*a* a low-frequency vibrating device such as a servo cylinder or an ultrasonic vibrating device, as shown by the dashed line in FIG. 1.

With this construction, because the pressing tool part 80 on the end of the pressing mechanism 8 vibrates as it makes contact with the sheet workpiece W, the forming efficiency improves, and it is possible to achieve improvements in shape precision and improvements in forming speed.

Next, the forming control unit 14 will be discussed.

Figure 24:
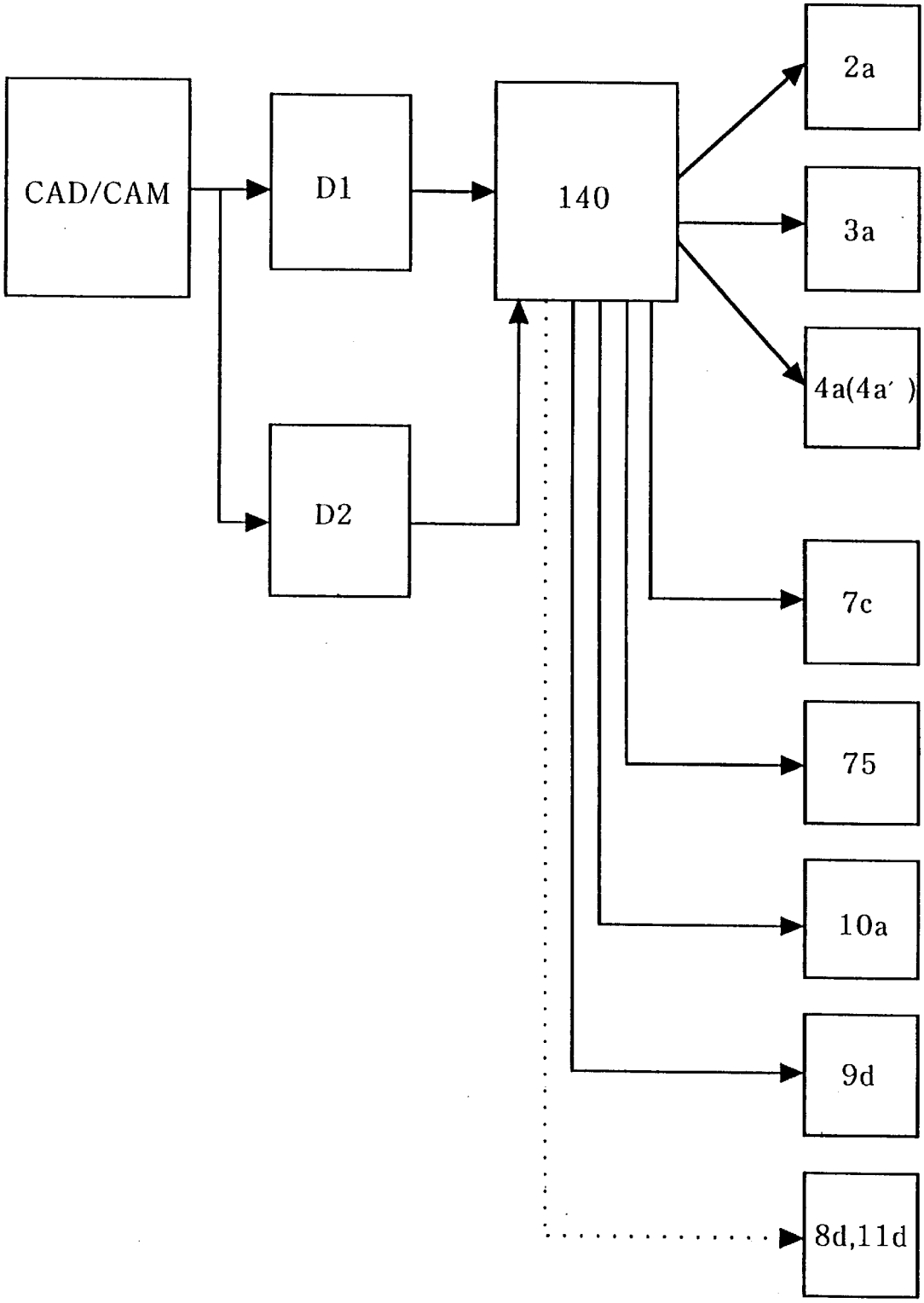
FIG. 24 is a schematic view of a control system of the invention.

FIG. 24 shows a control system of the invention schematically: the output side of a controller 140 comprising a computer is connected to the above-mentioned drive devices 2*a*, 3*a*, 4*a* , 4*a*' by way of amplifiers (not shown), and also to the drive parts and valves of at least the raising/lowering actuators 7*c*, 7*c*, the restraining actuators 75, the shifting actuators 10*a* of the material flow control mechanism, and the rotary drive device 9*d* of the balanced movement mechanism 9.

NC data D1 derived from three-dimensional CAD/CAM data D1 of a product to be formed is inputted to the controller 140 as a program, and data D2 on the material, sheet thickness, and mechanical characteristics such as elongation and tensile strength of the sheet is also inputted; computation is then carried out on this data as a whole to automatically control movement speeds, positions, pressures, directions and timings and so on of the drive devices 2*a*, 3*a*, 4*a* and 4*a*', the raising/lowering actuators 7*c*, 7*c*, the restraining actuators 75, the shifting actuators 10*a* of the material flow control mechanism, and the rotary drive device 9*d* of the balanced movement mechanism 9. For example, in the first preferred embodiment, at least a rate of descent and positions of the slider 4, rates of movement and movement directions of the first table 2 and the second table 3, operating directions and operating speeds and positions and strengths of the raising/lowering actuators 7*c*, 7*c*, and operating strengths and changes thereof of the restraining actuators 75 are each set, and successive commands are issued. The controller 140 has a switching circuit, and by this means the various above-mentioned means can be controlled independently as necessary.

A dieless forming operation carried out by an apparatus according to the invention will now be described.

FIGS. 25-A, 25-B through FIGS. 27-A, 27-B show states in a forming process carried out by the apparatus of the first preferred embodiment.

First, a ceiling plate form 6*b* corresponding to the product shape is prepared. For example when a product A has a shape of the kind shown in 27-B having large-area flat bottom b with a kidney-shaped profile, a considerably high side wall part (trunk part) c extending from this bottom b, and a flange d at the lower end of the side wall part (a shape often used for bath tubs and sinks), a ceiling plate form 6*b* having a plane shape matching the bottom profile shape of the product as shown in FIG. 27-A is prepared, and this ceiling plate form 6*b* is placed on the top of the stand 6*a* and fixed there by fixing means such as a bolt 62. When the product A has a short tube e for a water drain hole or the like in the bottom b, a projection 65 of a predetermined radius and height is provided on the ceiling plate form 6*b*.

Information including this product shape is inputted into the controller 140, control states and conditions of the various actuator means are computed as described above, and a program based on the shape of the product is set.

For forming, as shown in FIG. 25-A, the raising/lowering actuators 7*c*, 7*c* are operated to raised positions; the upper face of the support plate 7*b* is aligned with that of the ceiling plate form 6*b*; and a sheet workpiece W, for example a stainless steel sheet, is placed on the ceiling plate form 6*b* and the support plate 7*b*. The upper face of the ceiling plate form 6*b* abuts with the underside of the sheet workpiece W. The separate restraining plate 74 is placed on the periphery w of the sheet workpiece W, the restraining actuators 75, 75 are operated to apply a force to the restraining plate 74 in the sheet thickness direction, and the periphery w of the sheet workpiece W is thereby clamped.

With the apparatus in this state, the forming control unit 14 is operated. When this is done, in this first preferred embodiment, the first table 2 and the second table 3 are moved by numerical control so that the axis of the pressing tool part 80 of the pressing mechanism 8 faces the edge of the ceiling plate form 6*b* from vertically thereabove. Then, the slider 4 is driven by numerical control and the pressing tool part 80 is brought into abutment with a portion of the sheet workpiece W lying on the edge of the ceiling plate form 6*b*. This is the state shown in FIG. 25-A.

From this state the slider 4 is driven by numerical control to lower the pressing mechanism 8 by a predetermined amount, for example 0.5 to 1 mm, and the first table 2 and the second table 3 are moved in the X and Y-axis directions simultaneously to follow the profile shape of the bottom b of the product A, that is, the profile of the ceiling plate form 6*b*. In this example they are moved so as to describe a kidney-shape. The raising/lowering actuators 7*c*, 7*c* are lowered under a load from the pressing mechanism 8, and together with the sheet restraining mechanism 7*d* the support plate 7*b* moves in the thickness direction of the sheet.

Because the ceiling plate form 6*b* has an edge suitable for corner formation and a required thickness and is held at a fixed height by the stand 6*a* fixed to the base plate 5, the pressing tool part 80 of the pressing mechanism 8 mounted on the slider 4 presses the sheet workpiece W.

FIG. 38-B is a partial plan view of the same.

DETAILED DESCRIPTION OF THE INVENTION

Preferred embodiments of the invention will now be described on the basis of the accompanying drawings. The following first through fourth preferred embodiments are X, Y, Z-axis movement type dieless forming apparatuses.

FIG. 1 through FIG. 3 show a first preferred embodiment of a dieless forming apparatus according to the invention.

The reference numeral 1 denotes a bed (bed frame) mounted on a plinth; 2 a first table mounted on the bed 1 and movable in a horizontal direction and 3 a second table mounted on the first table 2 and movable in a horizontal direction orthogonal to the direction of movement of the first table 2. These first and second tables 2, 3 are respectively moved by numerically controlled drive devices (drive actuators) 2*a*, 3*a* such as a.c. servo motors or linear motors.

A slider 4 is mounted on a gate-shaped frame 100 fixed to the bed 1 and is moved by a numerically controlled drive device (drive actuator) 4*a* such as an a.c. servo motor or a linear motor in a direction.

A base plate 5 is fixed to the top of the second table 3, and a fixed pressing assembly 6 is mounted on a central part of the base plate 5.

The fixed pressing assembly 6 has a stand 6*a* fixed to the base plate 5 and attached to the top of this a ceiling plate form 6*b* having a plane shape matching the bottom profile of a product to be formed.

A holding mechanism 7 is made up of a plurality of support pillars 7*a* mounted on the base plate 5 radially outward of the stand 6*a* of the fixed pressing assembly 6, a support plate 7*b* disposed on the support pillars 7*a*, and at least one pair of raising/lowering actuators 7*c*, 7*c* fixed to the base plate 5 and having output parts 72 with upper ends connected to the support plate 7*b*.

The support plate 7*b* is means for supporting a sheet workpiece W of which forming is to be carried out and is shaped like a frame having a window hole 70 somewhat larger than the external profile dimensions of the ceiling plate form 6*b*. In this example, because the support pillars 7*a* do not move, the support plate 7*b* has cylindrical parts 71 on which it can slide along the support pillars 7*a*.

The raising/lowering actuators 7*c*, 7*c* are fluid pressure cylinders operated by air or oil pressure, and in this preferred embodiment the support plate 7*b* can be pushed up to the same level as the ceiling plate form 6*b* or pulled down from this state to a level below that of the ceiling plate form 6*b* by the raising/lowering actuators 7*c*, 7*c*.

A sheet restraining mechanism 7*d* for clamping a peripheral portion (flange portion) w of the sheet workpiece W between itself and the support plate 7*b* is provided on the support plate 7*b*. The sheet restraining mechanism 7*d* has a frame-shaped restraining plate 74 which makes contact with the upper side of the peripheral portion of the sheet workpiece W and a plurality of restraining actuators 75 for applying a controlled pressing force to the sheet periphery by way of the restraining plate 74. These elements on the base plate 5 constitute a tool set.

A pressing mechanism 8 functions as a tool for carrying out progressive forming in cooperation with the ceiling plate form 6*b* of the fixed pressing assembly 6. In this example the pressing mechanism 8 has a shaft part 8*c* interchangeably attached to a holder 8*a* fixed to the slider 4 and is moved in a Z-axis direction (the vertical direction) by the slider 4 being moved by the drive device 4*a*. The shaft part 8*c* has at a lower end thereof a curved pressing tool part 80 for making contact with the sheet workpiece W and carrying out forming.

A progressive forming control unit 14 includes a controller for controlling the operations of various driving means such as the drive devices 2*a*, 3*a* and 4*a*, the raising/lowering actuators 7*c*, 7*c* and the restraining actuators 75. The control system will be further discussed later.

FIG. 4 shows a second preferred embodiment of the invention. In this preferred embodiment, a single first table 2 is provided on a bed 1, a base plate 5 is fixed to this in the same way as in the first preferred embodiment, and a tool set of the kind described above is provided on this base plate 5.

A table 3' is provided on a gate-shaped frame 100 mounted on the bed 1, and a slider 4 fitted with a pressing mechanism 8 is fitted to this table 3'.

The direction of movement of the table 3' is a direction orthogonal to that of the first table 2, i.e. the Y-axis direction if the movement direction of the table 2 is the X-axis direction, and the table 3' and the slider 4 are respectively moved by numerically controlled drive devices 3*a*, 4*a* such as a.c. servo motors or a linear motors. Thus, in this second preferred embodiment, the pressing mechanism 8 moves in the X-axis (or Y-axis) and Z-axis directions and the base plate 5 and the tool set thereon move in the Y-axis (or X-axis) direction.

The rest of the construction is the same as that of the first preferred embodiment.

FIG. 5 and FIG. 6 show a third preferred embodiment of the invention. This preferred embodiment is suitable for the manufacture of large products of the kind mentioned earlier of side length for example 6000 mm. In this third preferred embodiment, a gantry frame 101 made up of square columns and rectangular beams rigidly joined to these columns is provided on a bed 1, a table 2' movable in an X-axis direction by a numerically controlled drive device 2*a* extends between two parallel sides of this gantry frame 101, a sliding table 3' movable in a Y-axis direction by a numerically controlled drive device 3*a* is fitted to this table 2', a slider 4 movable in a Z-axis direction by a numerically controlled drive device 4*a* is attached to the table 3', and a pressing mechanism 8 is mounted on the slider 4.

In this example, linear motors are used for the drive devices 2*a* and 3*a*. In FIG. 6, the reference numeral 20 denotes guide rails, 21 a magnet plate, 22 a coil slider, and 23 a linear scale.

In this preferred embodiment, the pressing mechanism 8 moves in three directions, the X-axis, the Y-axis and the Z-axis directions, and accordingly the base plate 5 is fixed to the bed 1 or to a bolster disposed on the bed 1.

The rest of the construction is the same as that of the first preferred embodiment.

FIG. 7 and FIG. 8 show a fourth preferred embodiment of the invention.

In this preferred embodiment, a gantry frame 101 made up of square columns and rectangular beams rigidly joined to these columns is provided on a bed 1, a table 2' movable in an X-axis direction by a numerically controlled drive device 2*a* extends between -two parallel sides of this gantry frame 101, a sliding table 3' movable in a Y-axis direction by a numerically controlled drive device 3*a* is fitted to this table 2', and a pressing mechanism 8 is mounted on this table 3'.

A table 4' movable in a Z-axis direction by a numerically controlled drive device 4*a'* is mounted on the bed 1, and a base plate 5 and a tool set thereon are mounted on the table 4'.

In this example linear motors are used for the drive devices 2*a* and 3*a*, an a.c. servo motor and a pinion driven by this are used for the drive device 4*a*, and a rack meshing with the pinion is used for the table 4'. Of course, a ball and screw arrangement may alternatively be used.

In this preferred embodiment the pressing mechanism 8 moves in two directions, an X-axis direction and a Y-axis direction, and the base plate 5 and the tool set thereon moves in a Z-axis direction.

The rest of the construction is the same as that of the first preferred embodiment.

FIG. 9 through FIG. 16 show tool sets suitable for use in the invention, and a characteristic of these is that they each have a balanced movement mechanism 9 for balancing movement of the support plate 7*b* and thus the sheet workpiece. The tool sets of FIG. 9 through FIG. 16 are used selectively in the first through fourth preferred embodiments described above.

FIG. 9 through FIG. 12 show a first preferred embodiment of a tool set having a balanced movement mechanism 9.

Gearboxes 9*e* having built-in pinions 9*b* of the kind shown in FIG. 10 are fixed to the base plate 5 at the positions of the support pillars 7*a*; the support pillars 7*a* have a length such that they can extend through the gearboxes 9*e* into guide holes in the base plate 5, and are each provided on one side thereof with a rack 9*a* for meshing with the respective pinion 9*b*. The upper ends of the support pillars 7*a* are connected to the support plate 7*b*, and when a pressing force acts on the support plate 7*b* in the Z-axis direction the support pillars 7*a* move up or down with their racks 9*a* rotating their respective pinions 9*b*.

Shafts 90 of the pinions 9*b* pass through the gearboxes 9*e*, and these shafts 90 are connected by rotation-synchronizing shafts 9*c* disposed on the base plate 5. The rotation-synchronizing shafts 9*c* are connected in gearboxes 91 by for example bevel gears so as to collectively form a rectangular shape, as shown in FIG. 12. Thus the pinions 9*b* meshing with the racks 9*a* of the support pillars 7*a* always rotate in synchrony; all of the support pillars 7*a* descend or ascend by equal amounts, and the support plate 7*b* undergoes parallel displacement with its horizontality maintained.

Although ordinary fluid pressure cylinders can be used for the raising/lowering actuators 7*c*, 7*c*, in this example magnetic rodless cylinders are used; casings thereof are fixed to the base plate 5, and tubes 72 serving as output parts thereof have upper ends fixed to the support plate 7*b* and lower ends extending to below the base plate 5, as shown in FIG. 11. When these magnetic rodless cylinders are used, there is the advantage that a large holding force can be realized with a compact construction.

FIG. 13 and FIG. 14 show a second version of a tool set having a balanced movement mechanism 9. In this version also the construction of the balanced movement mechanism 9 is the same as that shown in FIG. 9 through FIG. 12; however, numerically controlled hydraulic cylinders controlled by hydraulic servo valves 702 are used as the raising/lowering actuators 7*c*, 7*c* . As a result of these raising/lowering actuators 7*c*, 7*c* being used, in addition to the support plate 7*b* being able to ascend and descend in a parallel fashion, it is possible for a force pulling down or pushing up the support plate 7*b* to be controlled precisely, and the height position of the support plate 7*b* can also be controlled accurately.

FIG. 15 and FIG. 16 show a third version of a tool set having a balanced movement mechanism 9. In this version, the balanced movement mechanism 9 constitutes a drive system. That is, a rotary drive device 9*d* is mounted in the proximity of one of the rotation-synchronizing shafts 9*c*, and an output shaft of the rotary drive device 9*d* is connected to this rotation-synchronizing shaft 9*c* by way of a speed-reducer 9*f*.

A numerically controlled actuator such as an a.c. servo motor would normally be used as the rotary drive device 9*d*, although alternatively a hydraulic cylinder may be used to rotate the rotation-synchronizing shafts 9*c* using a rack.

When this rotary drive device 9*d* is provided, all of the pinions 9*b* are synchronously rotated by the operation of the rotary drive device 9*d* by way of the rotation-synchronizing shafts 9*c*, and because the support pillars 7*a* consequently are all made to descend or ascend equally by way of their racks 9*a*, the support plate 7*b* can ascend or descend while maintaining horizontality. Also, by means of output pulse control or torque control of the rotary drive device 9*d* it is possible to carry out accurate control of a pulling-down or pushing-up force on the support plate 7*b* and precise control of the height position of the support plate 7*b*. The raising/lowering actuators 7*c*, 7*c* function as balance cylinders, whereby the weight of the support plate 7*b* and the sheet and the sheet restraining mechanism 7*d* thereon can be canceled out. Therefore, a large load does not act on the support pillars 7*a*.

The fixed pressing assembly 6 will now be discussed.

FIG. 17-A and FIG. 17-B show an example of an attachment structure of the ceiling plate form 6*b* of the fixed pressing assembly 6 in the invention. In FIG. 17-A, a through hole 61 is provided in the ceiling plate form 6*b* in a position corresponding to a female screw hole 60 in the stand 6*a*, and a bolt 62 serving as fixing means is passed through this and screwed into the female screw hole 60 to fix the ceiling plate form 6*b* to the stand 6*a*. In FIG. 17-B, a boss 64 to serve as fixing means is provided on the underside of the ceiling plate form 6*b* and this boss 64 is fitted to the top of the stand 6*a*. The upper face of the ceiling plate form 6*b* does not necessarily have to be flat, and may alternatively be convex or concave.

Particularly when the ceiling plate form 6*b* has a complex shape, a three-dimensional ceiling plate form 6*b* may be used. FIG. 18-A and FIG. 18-B show examples of this, wherein a main part or all of a shape to be formed made of synthetic resin or metal. In each case is attached to the stand 6*a* and thereby fixed to the base plate 5.

FIG. 19 shows an example of a sheet restraining mechanism 7*d*, wherein a restraining actuator 75 is fixed to the support plate 7*b* by a bracket 750. Although a rotary restraining actuator 75 may be used, normally a hydraulic or pneumatic cylinder is used and a piston rod thereof faces the restraining plate 74 and during forming abuts with and applies a force to the restraining plate 74. Pipes connected to a piston side and a rod side of the cylinder are connected to a pressurized fluid supply (not shown) by a pressure control valve 701.

However, the invention is not limited to apparatuses simply having a restraining plate 74 and a plurality of restraining actuators 75 for applying a controlled restraining force to the periphery of the sheet by way of the restraining plate 74, and includes apparatuses having a material flow control mechanism 10 for, during forming, weakening the pressing force applied by the restraining actuators 75 and in this state actively causing the sheet workpiece W to flow into a forming area or, reversely, actively pulling the sheet workpiece W from the forming area. Such a material flow control mechanism 10 is particularly useful in forming a side wall which is vertical or at a near-vertical angle a or forming a side wall having a small angle to the horizontal.

FIG. 20 shows an example of a material flow control mechanism 10 for actively causing material of a sheet workpiece W to flow into a forming area during forming. A plurality of shifting actuators 10*a* are provided with a predetermined spacing around the periphery of the support plate 7*b* on the outer side of the sheet restraining mechanism 7*d*, and sliding jigs 10*b* for pushing the periphery w of the sheet workpiece W inward are attached to output parts of these shifting actuators 10*a*. The left half of FIG. 20 shows a state preceding the start of forming, and the right half shows an state wherein the periphery w of the sheet workpiece W has been pushed into an area where forming is being carried out by the pressing tool part 80. This prevents the sheet thickness of the side wall part from decreasing. In this example, the jigs 10*b* are made thin sliding plates and move along channels provided in the restraining plate 74 or channels provided in the support plate 7*b*. Distal end faces of the jigs 10*b* abut with and push upon the edge face of the periphery w.

FIG. 22 shows another jig 10*b*'. This jig has upper and lower clamping jaws 105, 105 for clamping the periphery w of the sheet workpiece W, and again can move along a channel provided in the restraining plate 74 or a channel provided in the support plate 7*b*. When this jig 10*b*' is used, the sheet workpiece W can be actively made to flow into the forming area or actively pulled away from the forming area by means of a single type of jig.

The shifting actuator 10*a* may be a hydraulic cylinder or may be a motor. In the former case, a piston rod is connected to the jig 10*b*, 10*b*'. In the latter case, a screw shaft joined to the output shaft of the motor is screwed into a female screw hole in the jig 10*b*, 10*b*'. Although the hydraulic cylinder or motor may be one of on/off-control type, it is a preferably numerically controlled one, for example a hydraulic servo cylinder or an a.c. servo motor; when these are used, the pushing position and pushing force can be controlled to match the forming shape well.

Next, the pressing mechanism 8 will be described in detail.

FIG. 22-A through FIG. 22-C show different versions of the pressing mechanism 8 used in the invention. In FIG. 22-A, the pressing tool part 80 is formed integrally with the distal end of the shaft part 8*c*. FIG. 22-B shows a more preferable type, wherein a spherical concavity is formed in the end of the shaft part 8*c* and a pressing tool part 80 consisting of a hard spherical member such as a bearing ball is freely rotatably fitted in this concavity. FIG. 22-C shows a still more preferable type, wherein the shaft part 8*c* has a lubricating hole 800 connecting with a spherical concavity and a lubricant is supplied through this to a pressing tool part 80 consisting of a spherical member.

When as in FIG. 22-B and FIG. 22-C the pressing tool part 80 is made freely rotatable, because its contact with the sheet material gives rise to rolling friction instead of sliding friction during forming, the production of excessive heat due to friction when a sheet is being formed at high speed can be prevented, and also there is the merit that it is possible to reduce the occurrence of working marks on the product and prevent spring-back of the product.

FIG. 23-A and FIG. 23-B show another version of the pressing mechanism 8 used in the invention, wherein a rotating shaft 8*e* is attached to the holder 8*a* and a shaft part 8*c* fitted with a pressing tool part 80 selected from the examples shown in FIG. 22-A through FIG. 22-C is eccentrically attached to the rotating shaft 8*e*. Any suitable rotating mechanism may be used, and in this example a drive motor is mounted on the holder 8*a* and a pulley on the output shaft thereof is connected by a belt to a pulley fixed to the rotating shaft 8*e*.

When this version shown in FIG. 23-A is employed, in addition to the pressing carried out by the pressing tool part 80, because the shaft part 8*c* rotates eccentrically, it beats the forming area W' as shown in FIG. 23-B, and thereby local plastic deformation is obtained and the occurrence of spring-back after forming is suppressed. Also, lubricity improves and the production of heat due to friction can be reduced.

The invention also includes cases wherein the pressing mechanism 8 has vibrating means 8*d*. This is realized by attaching to the holder 8*a* a low-frequency vibrating device such as a servo cylinder or an ultrasonic vibrating device, as shown by the dashed line in FIG. 1.

With this construction, because the pressing tool part 80 on the end of the pressing mechanism 8 vibrates as it makes contact with the sheet workpiece W, the forming efficiency improves, and it is possible to achieve improvements in shape precision and improvements in forming speed.

Next, the forming control unit 14 will be discussed.

FIG. 24 shows a control system of the invention schematically: the output side of a controller 140 comprising a computer is connected to the above-mentioned drive devices 2*a*, 3*a*, 4*a* , 4*a*' by way of amplifiers (not shown), and also to the drive parts and valves of at least the raising/lowering actuators 7*c*, 7*c*, the restraining actuators 75, the shifting actuators 10*a* of the material flow control mechanism, and the rotary drive device 9*d* of the balanced movement mechanism 9.

NC data D1 derived from three-dimensional CAD/CAM data D1 of a product to be formed is inputted to the controller 140 as a program, and data D2 on the material, sheet thickness, and mechanical characteristics such as elongation and tensile strength of the sheet is also inputted; computation is then carried out on this data as a whole to automatically control movement speeds, positions, pressures, directions and timings and so on of the drive devices 2*a*, 3*a*, 4*a* and 4*a*', the raising/lowering actuators 7*c*, 7*c*, the restraining actuators 75, the shifting actuators 10*a* of the material flow control mechanism, and the rotary drive device 9*d* of the balanced movement mechanism 9. For example, in the first preferred embodiment, at least a rate of descent and positions of the slider 4, rates of movement and movement directions of the first table 2 and the second table 3, operating directions and operating speeds and positions and strengths of the raising/lowering actuators 7*c*, 7*c*, and operating strengths and changes thereof of the restraining actuators 75 are each set, and successive commands are issued. The controller 140 has a switching circuit, and by this means the various above-mentioned means can be controlled independently as necessary.

A dieless forming operation carried out by an apparatus according to the invention will now be described.

FIGS. 25-A, 25-B through FIGS. 27-A, 27-B show states in a forming process carried out by the apparatus of the first preferred embodiment.

First, a ceiling plate form 6*b* corresponding to the product shape is prepared. For example when a product A has a shape of the kind shown in 27-B having large-area flat bottom b with a kidney-shaped profile, a considerably high side wall part (trunk part) c extending from this bottom b, and a flange d at the lower end of the side wall part (a shape often used for bath tubs and sinks), a ceiling plate form 6*b* having a plane shape matching the bottom profile shape of the product as shown in FIG. 27-A is prepared, and this ceiling plate form 6*b* is placed on the top of the stand 6*a* and fixed there by fixing means such as a bolt 62. When the product A has a short tube e for a water drain hole or the like in the bottom b, a projection 65 of a predetermined radius and height is provided on the ceiling plate form 6*b*.

Information including this product shape is inputted into the controller 140, control states and conditions of the various actuator means are computed as described above, and a program based on the shape of the product is set.

For forming, as shown in FIG. 25-A, the raising/lowering actuators 7*c*, 7*c* are operated to raised positions; the upper face of the support plate 7*b* is aligned with that of the ceiling plate form 6*b*; and a sheet workpiece W, for example a stainless steel sheet, is placed on the ceiling plate form 6*b* and the support plate 7*b*. The upper face of the ceiling plate form 6*b* abuts with the underside of the sheet workpiece W. The separate restraining plate 74 is placed on the periphery w of the sheet workpiece W, the restraining actuators 75, 75 are operated to apply a force to the restraining plate 74 in the sheet thickness direction, and the periphery w of the sheet workpiece W is thereby clamped.

With the apparatus in this state, the forming control unit 14 is operated. When this is done, in this first preferred embodiment, the first table 2 and the second table 3 are moved by numerical control so that the axis of the pressing tool part 80 of the pressing mechanism 8 faces the edge of the ceiling plate form 6*b* from vertically thereabove. Then, the slider 4 is driven by numerical control and the pressing tool part 80 is brought into abutment with a portion of the sheet workpiece W lying on the edge of the ceiling plate form 6*b*. This is the state shown in FIG. 25-A.

From this state the slider 4 is driven by numerical control to lower the pressing mechanism 8 by a predetermined amount, for example 0.5 to 1 mm, and the first table 2 and the second table 3 are moved in the X and Y-axis directions simultaneously to follow the profile shape of the bottom b of the product A, that is, the profile of the ceiling plate form 6*b*. In this example they are moved so as to describe a kidney-shape. The raising/lowering actuators 7*c*, 7*c* are lowered under a load from the pressing mechanism 8, and together with the sheet restraining mechanism 7*d* the support plate 7*b* moves in the thickness direction of the sheet.

Because the ceiling plate form 6*b* has an edge suitable for corner formation and a required thickness and is held at a fixed height by the stand 6*a* fixed to the base plate 5, when the pressing tool part 80 of the pressing mechanism 8 mounted on the slider 4 presses the sheet workpiece w, it plastically works the sheet workpiece W so as to bend it around the edge along the profile of the ceiling plate form 6*b*. As a result, a corner f and a bottom b matching the profile shape of the ceiling plate form 6*b* are formed.

When the pressing mechanism 8 has followed a path of movement matching the profile shape of the ceiling plate form 6*b* at a constant height at least one time, the pressing mechanism 8 is lowered by a freely predetermined amount, and in this state the first table 2 and the second table 3 are moved in the X and Y-axis directions simultaneously to follow the profile shape of a side wall c planned for the product A. Consequently a hitherto unworked part of the sheet workpiece W is plastically deformed and the support plate 7*b* moves in the thickness direction of the sheet together with the sheet restraining mechanism 7*d*.

As a result, with the descent of the support plate 7*b* the ceiling plate form 6*b* moves relatively upward and passes through the window hole 70 in the support plate 7*b* to a position thereabove. Thus, by repeating a process of lowering the pressing mechanism 8 by a freely predetermined amount each time the pressing mechanism 8 finishes following a path of movement matching the profile shape of the ceiling plate form 6*b* at a constant height and then moving the first table 2 and the second table 3 to follow the profile shape of the side wall c planned for the product A again at the new height, a side wall (trunk part) c is progressively formed in the sheet workpiece W.

When a predetermined side wall height has been achieved in this way, the lowering of the support plate 7*b* is stopped and at that position the support plate 7*b* is moved by the first table 2 and the second table 3 simultaneously in the X-axis and Y-axis directions to form a flange d by means of the support plate 7*b* and the pressing tool part 80 of the pressing mechanism 8. This is the state shown in FIG. 25-B.

By this means, a pro duct A having a large irregular bottom b such as that illustrated in FIG. 27-B is formed accurately and with high efficiency.

When a short tube e is to be for med on the bottom b of the product A, the pressing tool part 80 of the pressing mechanism 8 is brought into contact with the part of the outside edge of the projection 65 of the ceiling plate form 6*b*, the raising/lowering actuators 7*c*, 7*c* are placed without being lowered, and in this state the support plate 7*b* is moved by the first table 2 and the second table 3 on a path following the profile of the projection 65 and then the path is gradually moved outward until it matches the profile shape of the ceiling plate form 6*b*. By this means it is possible to form easily a bottom b having a short tube e.

In the case of the second preferred embodiment, a locus of movement of the pressing tool part 80 matching the profile shape of the ceiling plate form 6*b* is realized by movement of the support plate 7*b* in one direction (for example the X-axis direction) effected by operation of the first table 2 and movement of the pressing mechanism 8 in another direction (for example the Y-axis direction) effected by operation of the table 3', and the side wall part of the product is formed by this and descent of the pressing mechanism 8 effected by the numerically controlled slider 4 and descent operation of the raising/lowering actuators 7*c*, 7*c* as in the first preferred embodiment.

In the third preferred embodiment, the side wall part of the product is formed by the pressing mechanism 8 alone moving in the X, Y and Z-axis directions. In the fourth preferred embodiment, feeding of the pressing tool part 80 is carried out by the table 4' being moved in the Z-axis direction, and by the pressing mechanism 8 being moved simultaneously in the X-axis direction and the Y-axis direction in this state a locus of movement at a constant height based on the shape of the side wall is obtained and the side wall part of the product is formed.

In the invention, instead of mere elastic cushions such as springs, the holding mechanism 7 has the raising/lowering actuators 7*c*, 7*c* . Consequently, during forming of the side wall part c by the kind of associated operations described above, by operating the raising/lowering actuators 7*c*, 7*c* to push up or to pull down, it is possible to improve formability.

That is, for example when the material of the sheet is aluminum or an alloy thereof, in addition to the force applied by the pressing tool part 80 of the pressing mechanism 8, the weight of the support plate 7*b* and the restraining plate 74 and restraining actuators 75 thereabove acts on the side wall c during forming. Consequently, the side wall part is liable to crack or deform during forming.

In this kind of case, by means of a signal from the controller 140, the raising/lowering actuators 7*c*, 7*c* are deliberately operated in the upward direction, and when this is done, because the upward force applied to the support plate 7*b* (a force in the opposite direction to the forming direction) and the above-mentioned weight are approximately balanced, local loads cease to act on the material, and its formability improves. Thus it is possible to form a highly accurate product.

When a relatively thick sheet is being formed, on the other hand, the effective weight of the support plate 7*b* and the restraining plate 74 and restraining actuators 75 thereabove tends to be considerably diminished by forming resistance. Consequently, local deformation of the material is liable to occur; however, in this case, if the raising/lowering actuators 7*c*, 7*c* are deliberately operated downward (in the forming direction) and the support pillars 7*a* are thereby forcibly lowered, because the material is pulled in the forming direction its formability improves, and again it is possible to form a highly accurate product.

From the above it will be understood that by using the restraining actuators 75 and the raising/lowering actuators 7*c*, 7*c* together it is possible to carry out forming with much higher precision.

In the invention, the tool set may have a balanced movement mechanism 9. In this case, during Z-axis direction movement of the support plate 7*b*, due to the cooperation of the racks 9*a*, the pin ions 9*b* and the rotation-synchronizing shafts 9*c*, the support pillars 7*a* all always move up and down by equal amounts. At this time, because the raising/lowering actuators 7*c*, 7*c* function as balance cylinders canceling out the weight of the support plate 7*b*, the sheet workpiece W and the sheet restraining mechanism 7*d*, an excessive load does not act on the support pillars 7*a* supporting the support plate 7*b*. Consequently, even when a large-area sheet is being used in order to form a product of large dimensions and therefore the support plate 7*b* is large and heavy, the sheet can be moved smoothly with its horizontality maintained correctly every time the pressing tool part 80 completes its movement at a constant height, and thus the forming accuracy can be greatly improved.

Also, because the raising/lowering actuators 7*c*, 7*c* can forcibly pull the support plate 7*b* and hence the sheet workpiece W in the forming direction (downward) or push it up in the opposite direction (sideward), forming limits improve and it is possible to widen the range of products of which forming is possible. In particular, when hydraulic cylinders are used as the raising/lowering actuators 7*c*, 7*c* and pressurized hydraulic fluid supply control is carried out by means of hydraulic servo valves, by following program control or independently of program control it is possible to freely adjust the pressure with which the support plate 7*b* is pulled down or pushed up (pressure control) and carry out exact control, including position holding, of the height position of the support plate 7*b* (position control). Thus the maximum height of side wall that can be formed increases and it is possible to form an accurate product whether the sheet is thick or thin.

Also, when the rotation-synchronizing shafts 9*c* linking together the shafts 90 of the pinions 9*b* of the balanced movement mechanism 9 are rotated with a rotary drive device 9*d*, because the raising/lowering actuators 7*c*, 7*c* function as balance cylinders canceling out the weight of the support plate 7*b*, the sheet workpiece W and the sheet restraining mechanism 7*d*, the support plate 7*b* can be made to undergo parallel displacement without an excessive load being applied to any of the support pillars 7*a*. Furthermore, if a numerically controlled motor is used as the rotary drive device 9*d*, the height position of the support plate 7*b* can be freely adjusted with good precision. And because the force can also be controlled, by the drive mechanism being operated to deliberately lower the support pillars 7*a* or pull the support plate 7*b* downward with a freely determined force, it is possible to utilize the profile of the ceiling plate form 6*b* of the fixed pressing assembly 6 to constrict the sheet. Thus the maximum height of side wall that can be formed increases and it is possible to form an accurate product whether the sheet is thick or thin.

In the invention, because the ceiling plate form 6*b* of the fixed pressing assembly 6 is interchangeable, various shapes can be formed. FIG. 28-A and FIG. 28-B show an example of a case wherein a product having more than one bottom is obtained. In this case, as the ceiling plate form, as shown in FIG. 28-A, a plurality of ceiling plate forms 6*b*1, 6*b*2 are attached side-by-side to the tops of stands 6*a*, 6*a* of different heights. By carrying out the kind of operation described above using a fixed pressing assembly 6 like this it is possible simply, quickly and accurately to form a product A having a plurality of bottoms b1, b2 of different heights as shown in FIG. 28-B.

That is, by the pressing tool part 80 of the pressing mechanism 8 being moved on a path following the edge of the higher ceiling plate form 6*b*1 a corner part around a higher bottom b1 is formed, and then the pressing mechanism 8 and the sheet holding mechanism 7 are moved in the sheet thickness direction, by the pressing tool part 80 of the pressing mechanism 8 being made to follow a path of movement corresponding to the profile of the higher 6*b*1 a side wall c continuing from the higher bottom b1 is formed. The pressing tool part 80 of the pressing mechanism 8 is then made to move along a path following the edge of the lower ceiling plate form 6*b*2 to form a corner part around a lower bottom b2.

FIG. 29-A and FIG. 29-B show another example of a case in which a product having more than one bottom is obtained. In this case, ceiling plate forms 6*b*1, 6*b*2 are attached to the top of the outer of three stands 6*a*, 6*a*, 6*a* and a ceiling plate form 6*b*3 having a different height from the ceiling plate forms 6*b*1, 6*b*2 is attached to the top of the middle stand 6*a*.

By carrying out the kind of operation described above using a fixed pressing assembly 6 like this it is possible simply, quickly and accurately to form a product A having left and right high bottom parts b1, b2 and between these a bottom part b5 of a different height as shown in FIG. 29-B.

FIG. 30-A shows a fixed pressing assembly 6 suitable for forming a product A having a step part g in a side wall part of a kind seen in bath tubs and sinks and the like as shown in FIG. 30-B. A ceiling plate form for bottom formation 6*b*1 having a concave cutaway 67 is attached to stands 6*a*, 6*a* and a ceiling plate form 6*b*4 for step formation projecting further out than the concave cutaway 67 is attached to the ceiling plate form 6*b*1 in a position a required amount lower than the ceiling plate form 6*b*1.

When this fixed pressing assembly 6 is used, a bottom b with a constricted portion of the kind shown in FIG. 30-B is formed by movement of the pressing tool part 80 of the pressing mechanism 8 along the profile of the ceiling plate form for bottom formation 6*b*3. And the pressing mechanism 8 and the sheet holding mechanism 7 are moved in the sheet thickness direction every time one movement around the profile at a constant height is completed. As a result, a side wall part c having a side wall constriction part c' is formed, and then when it has reached the ceiling plate form 6*b*4 for step part formation the pressing tool part 80 of the pressing mechanism 8 is moved over the face of this ceiling plate form 6*b*4 to form a step part g.

In the examples given above, the ceiling plate forms 6*b*1, 6*b*2 do not necessarily have to be attached to separate stands, and alternatively for example a ceiling plate form with another ceiling plate form of a small area pre-fixed thereto may be attached to a single stand.

The plurality of ceiling plate forms may have any profile shapes, and the profile shapes of upper and lower ceiling plate forms 6*b*1, 6*b*2 may be made different, whereby it is possible to form a product having different higher and lower bottom profiles. FIG. 31-A through FIG. 31-C show an example of this. Here, a ceiling plate form for lower bottom formation 6*b*2 is attached to a stand 6*a* as shown in FIG. 31-A and a ceiling plate form for higher bottom formation 6*b*1 of a desired shape is mounted on this ceiling plate form 6*b*2 by way of intermediate stands 6*a*'. When this fixed pressing assembly 6 is used, it is possible to form simply and efficiently a product A of a complex shape combining differently shaped bottoms b3, b4 of the kind shown in FIG. 31-B and FIG. 31-C.

Preferably each of the above-mentioned ceiling plate forms is removably attached to its stand by means of one of the attachment structures described above and shown in FIG. 17-A and FIG. 17-B.

In the invention, as the sheet restraining mechanism 7*d*, there are provided a restraining plate 74 on the upper face of the periphery of the sheet workpiece W and a plurality of restraining actuators 75 for applying a controlled restraining force to this restraining plate 74.

Therefore, a high side wall part can be made by forming a corner f around the bottom b by movement of the pressing tool part 80 along the profile of the ceiling plate form 6*b* and then easing the pressing force of the restraining actuators 75 when forming the sidewall c. When this is done, because the clamping force on the periphery w of the sheet workpiece W is weakened, the material flows as shown by an arrow in FIG. 19 into an area W' where forming is carried out by the pressing tool part 80, and because by this means a constriction is added to the forming state it is possible to form a product having a high vertical wall easily and with good accuracy.

Figure 21:
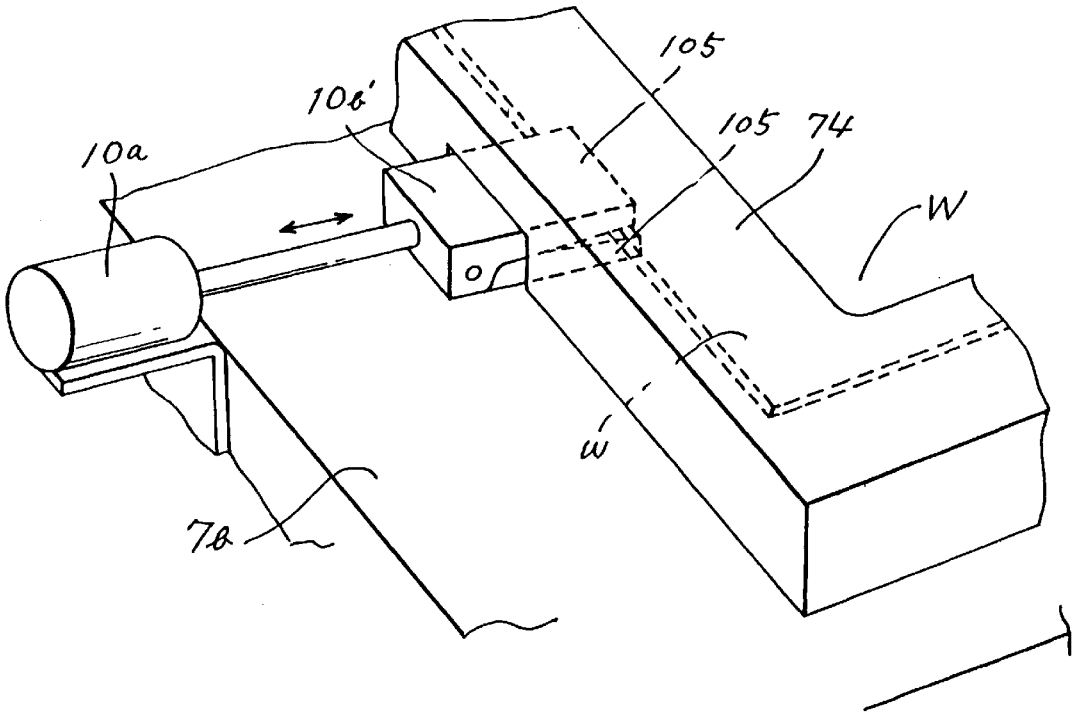
FIG. 21 is a sectional view of a second example of a forming control mechanism of the invention in use.

Also, when a material flow control mechanism 10 of the kind shown in FIG. 20 and FIG. 21 is also used, it is possible to eliminate problems of material elongation limit and forming shape (when the shape has a high sidewall part which is vertical or at a near-vertical angle $\alpha$).

That is, in forming the side wall part, the pressing force of the restraining actuators 75 positioned on a part where flow of the material is required is eased, or further a minute gap of for example 0.1 mm is actively formed in the sheet thickness direction between them and the sheet periphery, and in this state the shifting actuators 10*a* are operated and the jigs 10*b* are advanced while progressive forming of the kind described above is carried out. When this is done, as shown in the right half of FIG. 21, the periphery of the sheet workpiece W is forcibly pushed inward and the amount of material supplied to the forming area W' increases. As a result, excessive elongation of the material and consequent reduction in the sheet thickness are suppressed, there is no occurrence of cracking and the like, the sheet thickness does not become thin in places, and a high side wall part can be formed at a steep angle.

FIG. 32-A through FIG. 32-D show a forming example in which a material flow control mechanism 10 is used. This example is a case of making a boat shape wherein the angle $\alpha$ to the vertical of side wall parts c1, c1 of two opposing sides is for example 10°, and as shown in FIG. 32-C parallel notches wc, wc are pre-worked in two corresponding sides of a sheet workpiece W. This is fitted to a support plate 7*b* having a window hole 70, a restraining plate 74 is placed on the sheet periphery w, and progressive forming is carried out as described above. At this time, a normal forming pressing force is applied by the respective restraining actuators 75, 75 to the two sides at 90° to the side wall parts c1, c1 of the product, while the pressing force applied by the restraining actuators 75 corresponding to the side wall parts c1, c1 is weakened and together with this the shifting actuators 10*a* of the material flow control mechanism 10 disposed there are operated at predetermined forces and speeds (amounts). As a result, in the forming area of the side wall parts c1, c1, because material is actively fed in as shown by broken lines in FIG. 32-C, a side wall part of the desired angle is formed with good precision. This material flow control mechanism 10 is normally effective when used for angles $\alpha$ nearer to vertical than 23°.

It is also possible to use the material flow w control mechanism 10 to actively pull material outward from the forming area during progressive forming. This is beneficial when using a material having a large elongation to make a product whose angles to the horizontal are relatively small, for example flat-bottomed boat shapes and vehicle fuel tanks. That is, as the movement of the pressing tool part 80 at a constant height is progressively repeated the material elongates, and this combines with the pressing force of the pressing tool part 80 to make the material swell out in the sheet thickness direction so that a creasing phenomenon occurs and forming is liable to become impossible. One conceivable way of preventing this is to use a three-dimensional die as the ceiling plate form 6*b*, but by this measure alone it is still not possible to prevent the phenomenon. However, if a material flow control mechanism 10 is used, it is possible to suppress the phenomenon with certainty and make an accurate product. This material flow control mechanism 10 is normally effective when used for angles $\beta$ nearer to the horizontal than 14°.

FIGS. 33-A through 33-C and FIGS. 33-A and 33-B show an example wherein both pushing of material into a forming area and pulling of material from a forming area are carried out by a material flow control mechanism 10. The shape to be formed, as shown in FIG. 33-A, has the characteristic that a rear side wall part c1 makes a small angle β to the vertical and a side wall part c2 opposite this makes a small angle to the horizontal. In this case, as shown in FIG. 33-B, a sheet workpiece W worked into a shape such that a portion at the side wall part c1 and two sides at 90° to the side wall part c2 project outward is used.

The sheet workpiece W is fitted to a support plate 7*b* as shown in FIG. 33-C and the pressing tool part 80 is moved in a clockwise direction from the start position P of FIG. 33-B to carry out progressive forming, and at this time a normal forming pressing force is applied by the respective restraining actuators 75, 75 to the two sides at the portion at side wall part cl shifting actuators 10*a* are operated at predetermined forces and speeds (amount) to pushing of material into a forming area while at the portion at the side wall part c2 shifting actuators 10*a* are operated at predetermined forces and speeds (amounts) to pull material outward. FIG. 34-A and FIG. 34-B show this state, and from these figures it can be seen that it is possible to form with good precision both a side wall part cl having a near-vertical angle and a side wall part c2 having a near-horizontal angle.

The invention has various means for forming.

FIGS. 35-A through 35-E show a sheet holding mechanism suitable for a case wherein a product A has a flange d with a bent-back free edge d1 as shown in FIG. 35-A and 35-B.

In this case, as the sheet holding mechanism, in addition to the support plate 7*b* a framelike auxiliary support plate 7*e* of the kind shown in FIG. 35-C is used. In this auxiliary support plate 7*e* is formed a window hole 76 for allowing a ceiling plate form 6*b* to pass through, an annular step face 77 around this window hole 76, and through holes 78 on the outer side of this for bolts to the support plate 7*b*.

The auxiliary support plate 7*e* is placed on the support plate 7*b* and fixed integrally thereto with bolts. The sheet workpiece W is then disposed on the auxiliary support plate 7*e* and clamped with the restraining plate 74 of the sheet restraining mechanism 7*d*.

Progressive forming is then carried out as described above, but in this case, in the final stage of forming, the pressing tool part 80 of the pressing mechanism 8 is brought into contact with the annular step face 77 of the auxiliary support plate 7*e* and then the pressing tool part 80 is moved on a locus following the annular step face 77. By this means, the sheet workpiece W is formed as shown in FIG. 35-E into a shape made up of a horizontal portion d following the step face shape of the annular step face 77, a portion d1 rising from this, and a portion d2 extending horizontally from the end of the rising portion d1.

Thus, when the portion d2 extending horizontally from the end of the rising portion d1 is cut off after forming, the product shape shown in FIG. 35-A is obtained.

FIG. 36-A and FIG. 36-B show another example of an auxiliary support plate 7*e*. A window hole 76 for allowing a ceiling plate form 6*b* to pass through is formed in this auxiliary support plate 7*e* and a groovelike annular step face 77 is formed in the plate face around the window hole 76. Otherwise this auxiliary support plate 7*e* is the same as that shown in FIG. 35-C. Here, if an eccentric type of pressing tool part such as that shown in FIG. 23-A is used as the pressing tool part 80 of the pressing mechanism 8, a synergistic effect of a side-beating action improves the shape precision.

From the cost point of view it is basically preferable for a plate member to be used as the ceiling plate form 6*b*. When it has a complex shape, a three-dimensional ceiling plate form can be used, or to avoid this an elastic bag 12 of the kind shown in FIGS. 37-A and 37-B can be used. The elastic bag 12 is a bag made of rubber or synthetic resin and is disposed between the base plate 5 and the ceiling plate form 6*b* where required in the circumferential direction. During forming, the elastic bag 12 is expanded by being filled with a fluid (air or hydraulic fluid or the like) by way of a control valve, and with this state maintained the progressive forming described above is carried out. When this is done, an essentially three-dimensional die is formed, and because the elastic bag 12 performs a back-up function the forming of shapes with small angles to the horizontal becomes easy. It also reduces spring-back of formed parts and prevents localized deformations.

When the sheet is thin or when the area of the bottom of the product is large, a sheet fixing plate 13 having dimensions slightly smaller than those of the bottom shape of the product is used, as shown in FIGS. 37-A and 37-B. This sheet fixing plate 13 is disposed on top of the sheet workpiece W and fixed to the ceiling plate form 6*b*, and then the progressive forming described above is carried out. When this is done, because unnecessary forces caused by forming do not act on the part to become the bottom, bending and twisting of the bottom are effectively suppressed and the shape accuracy improves.

The invention includes versions wherein a lubricating mechanism is built in to the pressing mechanism 8 or a lubricating mechanism 11 is used together with the pressing mechanism 8. This may simply be made an oil bath consisting of a lubricant such as lubricating oil received inside the restraining plate 74 of the sheet restraining mechanism 7*d* after the sheet workpiece W is laid. However, preferably, a spray nozzle 11a having a nozzle hole pointed at or near the pressing tool part 80 is attached directly to the pressing mechanism 8 or to the holder 8*a* by a link fitting 11*b*, and this spray nozzle 11*a* is connected to an external lubricant tank 11*e* by a hose 11*c* and a pump 11*d*. Recovering means 11*f* connecting with the lubricating tank 11*e* is directly attached to the pressing mechanism 8 on the opposite side thereof from the spray nozzle 11*a* or is attached to the holder 8*a* by way of the link fitting 11*b*.

By this means, a circulatory lubricating and cooling system for constantly supplying a lubricant j to where forming is being carried out by the pressing mechanism 8 and recovering the lubricant is provided. As a result, adhesion, which readily occurs with stainless steel materials during high-speed forming in excess of for example 10 m/min, is prevented, and with aluminum materials the occurrence of splitting is prevented, and high-speed forming of over 30 m/min becomes possible.

The invention of course includes the use of this lubricating mechanism 11 together with the vibrating means 8*d* described above, and by using these selectively together with the material flow control mechanism 10 and the balanced movement mechanism 9 and so on described above it is possible to form a desired product efficiently whatever the material, sheet thickness, forming shape and forming force.

INDUSTRIAL APPLICABILITY

The dieless sheet-forming apparatus of the present invention is suitable for the small-volume production of special-shape products from metal or nonmetal sheet, and has the merits that equipment cost is low, changes to forming shape are easy, efficiency is good, and there is little noise. Therefore, the apparatus can be used in the making of bottomed products in any field, including vehicle parts, aviation parts, building materials, marine parts, kitchen products and bathroom products.

What is claimed is:

1. A dieless sheet-forming apparatus for progressively forming a sheet into a three-dimensional shape, comprising:

i. a tool set having a base plate (5), a fixed pressing assembly (6), a sheet holding mechanism (7) and a sheet restraining mechanism (7*d*), the fixed pressing assembly (6) being provided on the base plate (5) and having a stand (6*a*) erected on the base plate (5) and a ceiling plate form (6*b*), attached to the top of the stand (6*a*), having a plane shape matching the bottom profile of a product to be formed, the holding mechanism (7) having a plurality of support pillars (7*a*) disposed on the base plate (5), a support plate (7*b*) having a window hole (70) surrounding the ceiling plate form (6*b*) and movable in a Z-axis direction on the support pillars (7*a*), and at least one pair of raising/lowering actuators (7*c*) fixed to the base plate (5) and having output ends connected to the support plate (7*b*), the sheet restraining mechanism (7*d*) having a framelike restraining plate (74) for clamping the periphery of a sheet in the thickness direction of the sheet between itself and the support plate (7*b*) and a restraining actuator (75) for applying a controlled restraining force to the sheet periphery by way of this restraining plate (74);

ii. a pressing mechanism (8), disposed above the holding mechanism (7), having at a distal end thereof a pressing tool part (80) for making contact with the upper face of the sheet and forming a product shape in cooperation with the ceiling plate form (6*b*); and iii. a plurality of numerically controlled drive devices for moving the tool set and the pressing mechanism (8) with respect to each other in X-axis, Y-axis and Z-axis directions, which drive devices move the pressing tool part (80) around the ceiling plate form (6*b*) on a path of movement matching the product shape and move the pressing mechanism (8) and the support plate (7*b*) in the thickness direction of the sheet with respect to the ceiling plate form (6*b*).

2. A dieless sheet-forming apparatus for progressively forming a sheet into a three-dimensional shape, comprising:

i. a tool set having a base plate (5), a fixed pressing assembly (6), a sheet holding mechanism (7), a sheet restraining mechanism (7*d*) and a balanced movement mechanism (9), the fixed pressing assembly (6) being provided on the base plate (5) and having a stand (6*a*) erected on the base plate (5) and a ceiling plate form (6*b*), attached to the top of the stand (6*a*), having a plane shape matching the bottom profile of a product to be formed, the holding mechanism (7) having a plurality of support pillars (7*a*) disposed on the base plate (5), a support plate (7*b*) having a window hole (70) surrounding the ceiling plate form (6*b*) and movable in a Z-axis direction on the support pillars (7*a*), and at least one pair of raising/lowering actuators (7*c*) fixed to the base plate (5) and having output ends connected to the support plate (7*b*), the sheet restraining mechanism (7*d*) having a framelike restraining plate (74) for clamping the periphery of a sheet in the thickness direction of the sheet between itself and the support plate (7*b*) and a restraining actuator (75) for applying a controlled restraining force to the sheet periphery by way of this restraining plate (74), the balanced movement mechanism (9) having on the support pillars (7*a*) and the base plate (5) means for making the support plate (7*b*) maintain horizontality as it moves;

ii. a pressing mechanism (8), disposed above the holding mechanism (7), having at a distal end thereof a pressing tool part (80) for making contact with the upper face of the sheet and forming a product shape in cooperation with the ceiling plate form (6*b*); and iii. a plurality of numerically controlled drive devices for moving the tool set and the pressing mechanism (8) with respect to each other in X-axis, Y-axis and Z-axis directions, which drive devices move the pressing tool part (80) around the ceiling plate form (6*b*) on a path of movement matching the product shape and move the pressing mechanism (8) and the support plate (7*b*) in the thickness direction of the sheet with respect to the ceiling plate form (6*b*).

3. A dieless sheet-forming apparatus according to claim 2, wherein the balanced movement mechanism (9) comprises racks (9*a*) provided on the support pillars (7*a*), pinions (9*b*) provided on the base plate (5) in the proximities of the support pillars (7*a*) and meshing with the racks (9*a*) of the respective support pillars (7*a*), and rotation-synchronizing shafts (9*c*) connecting shafts of the pinions (9*b*) together.

4. A dieless sheet-forming apparatus according to claim 2, wherein the balanced movement mechanism (9) comprises racks (9*a*) provided on the support pillars (7*a*), pinions (9*b*) provided on the base plate (5) in the proximities of the support pillars (7*a*) and meshing with the racks (9*a*) of the respective support pillars (7*a*), rotation-synchronizing shafts (9*c*) connecting shafts of the pinions (9*b*) together, and a rotary drive device 9*d* attached to the rotation-synchronizing shafts (9*c*).

5. A dieless sheet-forming apparatus according to claim 1, wherein the raising/lowering actuators (7*c*) are cylinder type actuators operated by fluid pressure and having rods connected to the support plate (7*b*).

6. A dieless sheet-forming apparatus according to claim 1, wherein the raising/lowering actuators (7*c*) are rodless cylinders having tubes each with an end connected to the support plate (7*b*).

7. A dieless sheet-forming apparatus according to claim 1, wherein the holding mechanism (7) further comprises a material flow control mechanism (10) having a plurality of shifting actuators (10*a*) disposed at the periphery of the support plate (7*b*) and jigs (10*b*), (10*b*') for forcibly pushing the sheet toward a forming area during forming under the action of the shifting actuators (10*a*).

8. A dieless sheet-forming apparatus according to claim 1, wherein the holding mechanism (7) further comprises a material flow control mechanism (10) having a plurality of shifting actuators (10*a*) disposed at the periphery of the support plate (7*b*) and jigs (10*b*') for forcibly pulling the sheet outward during forming under the action of the shifting actuators (10*a*).

9. A dieless sheet-forming apparatus according to claim 1, wherein the stand (6*a*) has in its top a female screw hole and the ceiling plate form (6*b*) is interchangeably fixed to the stand (6*a*) by a bolt being screwed into the female screw hole.

10. A dieless sheet-forming apparatus according to claim 1, wherein the ceiling plate form (6*b*) comprises a plurality of ceiling plate forms positioned with spacing in the vertical direction or in the horizontal direction.

11. A dieless sheet-forming apparatus according to claim 1, wherein the ceiling plate form (6*b*) has a three-dimensional shape including a top face for bottom formation.

12. A dieless sheet-forming apparatus according to claim 1, wherein in addition to the support plate (7*b*) the holding mechanism (7) comprises an auxiliary support plate (7*e*) having a window hole (76) surrounding the ceiling plate form (6*b*) and around this window hole (76) an annular step face (77), the auxiliary support plate (7*e*) being laid on the support plate (7*b*).

13. A dieless sheet-forming apparatus according to claim 1, wherein in addition to the support plate (7*b*) the holding mechanism (7) comprises an auxiliary support plate (7*e*) having a window hole (76) surrounding the ceiling plate form (6*b*) and around this window hole (76) an annular step face (77) forming a groove, the auxiliary support plate (7*e*) being laid on the support plate (7*b*).

14. A dieless sheet-forming apparatus according to claim 1, wherein the pressing mechanism (8) is bar-shaped and the pressing tool part (80) is a freely rotatable spherical member.

15. A dieless sheet-forming apparatus according to claim 1, wherein the pressing mechanism (8) is bar-shaped and the pressing tool part (80) is a freely rotatable spherical member and the pressing mechanism (8) has a lubricating hole (800) for supplying lubricant to the spherical member.

16. A dieless sheet-forming apparatus according to claim 1, wherein the pressing mechanism (8) is rotatable about its own axis and has a pressing tool part (80) which is eccentric from the shaft center of the pressing mechanism (8).

17. A dieless sheet-forming apparatus according to claim 1, wherein the pressing mechanism (8) has a nozzle (11*a*) having a nozzle hole pointing toward the pressing tool part (80) or the vicinity thereof and means for supplying lubricant to the nozzle (11*a*).

18. A dieless sheet-forming apparatus according to claim 1, wherein the pressing mechanism (8) has a vibrating mechanism (8*d*).

19. A dieless sheet-forming apparatus according to claim 1, wherein an elastic bag (12) supporting a predetermined portion of the underside of the sheet is interposed between the base plate (5) and the ceiling plate form (6*b*).

20. A dieless sheet-forming apparatus according to claim 1, having over the whole of or a predetermined portion of the ceiling plate form (6*b*) an auxiliary fixing plate (13) for clamping between itself and the ceiling plate form (6*b*) a portion of the sheet to become the bottom of a product.

21. A dieless sheet-forming apparatus according to claim 1, having on a bed (1) tables (3), (2) of two stages supporting the tool set, the tables (3), (2) being moved in X-axis and Y-axis directions by drive devices (3*a*), (3*a*), wherein the pressing mechanism (8) is mounted on a slider (4) disposed on a gate-shaped frame (100) above the bed (1) and is moved in a Z-axis direction by a drive device (4*a*).

22. A dieless sheet-forming apparatus according to claim 1 having on a bed (1) a table (2) of a single stage, this table (2) being moved in one direction, either an X-axis direction or a Y-axis direction, by a drive device (2*a*), wherein the pressing mechanism (8) is mounted on a slider (4) mounted on a table (3') disposed on a gate-shaped frame (100) above the bed (1) and moved in two directions, a Z-axis direction and either a Y-axis direction or an X-axis direction, by drive devices (3*a*), (4*a*).

23. A dieless sheet-forming apparatus according to claim 1, wherein a gantry frame (101) is provided above a bed (1), a table (2') movable in an X-axis direction by a drive device (2*a*) is provided on the gantry frame (101), a table (3') movable in a Y-axis direction by a drive device (3*a*) is disposed on the table (2'), a slider (4) movable in a Z-axis direction by a drive device (4*a*) is mounted on the table (3'), the pressing mechanism (8) is mounted on the slider (4), and the tool set is mounted on the bed (1).

24. A dieless sheet-forming apparatus according to claim 1, wherein a gantry frame (101) is provided above a bed (1), a table (2') movable in an X-axis direction by a drive device (2*a*) is provided on the gantry frame (101), a table (3') movable in a Y-axis direction by a drive device (3*a*) is disposed on the table (2'), the pressing mechanism (8) is mounted on the table (3'), a table (4') movable in a Z-axis direction by a drive device (4*a*) is provided on the bed (1), and the tool set is mounted on the table (4').

25. A dieless sheet-forming apparatus according to claim 1, wherein the drive devices (2*a*), (3*a*) and (4*a*) are linear motors.

* * * * *